US012439987B1

(12) United States Patent
Weintraub et al.

(10) Patent No.: US 12,439,987 B1
(45) Date of Patent: Oct. 14, 2025

(54) BASEBALL STYLE CAP, SUN VISOR CAP, AND GYM WRAP DEVICE HAVING IMPROVED MOISTURE ABSORPTION AND COOLING

(71) Applicant: Save Your Do, LLC, San Juan Capistrano, CA (US)

(72) Inventors: Marc David Weintraub, San Juan Capistrano, CA (US); Nicole Ari Parker, Manhattan Beach, CA (US)

(73) Assignee: SAVE YOUR DO, LLC, San Juan Capistrano, CA (US)

( * ) Notice: Subject to any disclaimer, the term of this patent is extended or adjusted under 35 U.S.C. 154(b) by 0 days.

(21) Appl. No.: 18/522,494

(22) Filed: Nov. 29, 2023

(51) Int. Cl.

| | |
|---|---|
| ***A42B 1/008*** | (2021.01) |
| ***A42B 1/0182*** | (2021.01) |
| ***A42B 1/019*** | (2021.01) |
| *A63B 71/10* | (2006.01) |

(52) U.S. Cl.
CPC ..... *A42B 1/008* (2013.01); *A42B 1/0182* (2021.01); *A42B 1/019* (2021.01); *A63B 71/10* (2013.01)

(58) Field of Classification Search
CPC ..... A41B 1/008; A41B 1/0182; A41B 1/019; A63B 71/10
See application file for complete search history.

(56) References Cited

U.S. PATENT DOCUMENTS

| | | | | |
|---|---|---|---|---|
| 4,856,116 | A * | 8/1989 | Sullivan | A61F 9/045 2/DIG. 11 |
| 5,453,314 | A * | 9/1995 | Collier | B32B 37/1292 250/516.1 |
| 5,471,683 | A * | 12/1995 | Moretz | D04B 21/14 2/DIG. 11 |
| 5,566,395 | A * | 10/1996 | Nebeker | A42C 5/02 2/418 |
| 5,630,230 | A * | 5/1997 | Fujino | A41D 20/005 2/200.1 |
| 5,887,284 | A * | 3/1999 | Simmons | A42C 5/02 2/184 |
| 8,533,869 | B1 * | 9/2013 | Capuano | A42B 3/12 2/411 |
| 2002/0104150 | A1 * | 8/2002 | Hill | A42B 1/041 2/174 |
| 2006/0096004 | A1 * | 5/2006 | Friton | A42B 1/018 2/120 |
| 2007/0080182 | A1 * | 4/2007 | Thatcher | A45F 3/14 224/682 |

(Continued)

*Primary Examiner* — Bao-Thieu L Nguyen
(74) *Attorney, Agent, or Firm* — Reising Ethington P.C.

(57) ABSTRACT

A baseball style cap having a crown portion, a brim, and a sweatband is provided. The sweatband has a first polyester mesh fabric layer and a moisture activated cooling mesh fabric layer. The first polyester mesh fabric layer has a plurality of holes extending therethrough each having a first opening size. The moisture activated cooling mesh fabric layer is constructed of substantially 55% nylon yarn and substantially 45% polyester yarn. The crown portion has a second polyester mesh fabric layer and a third polyester mesh fabric layer. The second polyester mesh fabric layer has a plurality of holes extending therethrough with the first opening size. The third polyester mesh fabric layer has a plurality of holes extending therein having a second opening size smaller than the first opening size.

7 Claims, 18 Drawing Sheets

(56) References Cited

U.S. PATENT DOCUMENTS

| | | | | |
|---|---|---|---|---|
| 2008/0172779 | A1* | 7/2008 | Ferguson | A41D 31/285 2/455 |
| 2009/0144878 | A1* | 6/2009 | Mina | B32B 5/26 15/210.1 |
| 2013/0025036 | A1* | 1/2013 | Turner | A42B 3/125 2/455 |
| 2013/0199562 | A1* | 8/2013 | Parker | A45D 8/40 132/273 |
| 2014/0109292 | A1* | 4/2014 | Calhoun | A42C 5/04 2/171.3 |
| 2017/0087924 | A1* | 3/2017 | Aihara | D06Q 1/12 |
| 2018/0030626 | A1* | 2/2018 | Chen | A41D 13/0053 |
| 2018/0161194 | A1* | 6/2018 | Takizawa | A61F 5/56 |
| 2020/0390247 | A1* | 12/2020 | Taylor | B32B 5/24 |
| 2024/0277089 | A1* | 8/2024 | Chen | A41D 31/125 |

* cited by examiner

BASEBALL STYLE CAP, SUN VISOR CAP, AND GYM WRAP DEVICE HAVING IMPROVED MOISTURE ABSORPTION AND COOLING

BACKGROUND

Athletes often wear baseball style caps, sun visor caps, and gym wrap devices when exercising. When the athletes are exerting themselves, they often sweat profusely and often the baseball style caps, sun visor caps, and gym wraps are not able to absorb all of the sweat. As a result, the sweat undesirably flows down the face of the athletes which can distract the athlete when they are engaged in a particular sport. Further, the heads of the athletes may not be cooled sufficiently by the baseball style caps, sun visor caps, and gym wrap devices when the athletes are engaged in a particular sport.

The inventor herein has recognized a need for an improved baseball style cap, an improved sun visor cap, and an improved gym wrap device that has improved moisture absorption and improved cooling functionality.

SUMMARY

A baseball style cap in accordance with an exemplary embodiment is provided. The baseball style cap includes a crown portion and a brim that is coupled to the crown portion. The baseball style cap further includes a sweatband that is coupled to the crown portion. The sweatband has a first polyester mesh fabric layer and a moisture activated cooling mesh fabric layer. The first polyester mesh fabric layer is configured to contact a head of a user. The first polyester mesh fabric layer has a plurality of holes extending therethrough. Each of the plurality of holes of the first polyester mesh fabric layer has a first opening size. The moisture activated cooling mesh fabric layer is coupled to the first polyester mesh fabric layer and contacts the crown portion. The moisture activated cooling mesh fabric layer is constructed of substantially 55% nylon yarn and substantially 45% polyester yarn. The crown portion has a second polyester mesh fabric layer and a third polyester mesh fabric layer. The second polyester mesh fabric layer contacts the moisture activated cooling mesh fabric layer. The second polyester mesh fabric layer has a plurality of holes extending therethrough. Each of the plurality of holes of the second polyester mesh fabric layer has the first opening size. The third polyester mesh fabric layer is coupled to the second polyester mesh fabric layer. The third polyester mesh fabric layer has a plurality of holes extending into the third polyester mesh fabric layer. Each of the plurality of holes of the third polyester mesh fabric layer has a second opening size. The second opening size is smaller than the first opening size.

A sun visor cap in accordance with another exemplary embodiment is provided. The sun visor cap includes a brim and a sweatband that is coupled to the brim. The sweatband has a first polyester mesh fabric layer, a moisture activated cooling mesh fabric layer, and a second polyester mesh fabric layer. The first polyester mesh fabric layer is configured to contact a head of a user. The first polyester mesh fabric layer has a plurality of holes extending therethrough. Each of the plurality of holes of the first polyester mesh fabric layer has a first opening size. The moisture activated cooling mesh fabric layer is coupled to the first polyester mesh fabric layer. The moisture activated cooling mesh fabric layer is constructed of substantially 55% nylon yarn and substantially 45% polyester yarn. The second polyester mesh fabric layer is coupled to the moisture activated cooling mesh fabric layer such that the moisture activated cooling mesh fabric layer is disposed between and contacts the first and second polyester mesh fabric layers. The second polyester mesh fabric layer has a plurality of holes extending into the second polyester mesh fabric layer. Each of the plurality of holes of the second polyester mesh fabric layer has a second opening size. The second opening size is smaller than the first opening size.

A gym wrap device in accordance with another exemplary embodiment is provided. The gym wrap device includes a central wrap portion and first and second end wrap portions that are coupled to first and second ends, respectively, of the central wrap portion. The central wrap portion has a first polyester mesh fabric layer, a moisture activated cooling mesh fabric layer, and a second polyester mesh fabric layer. The first polyester mesh fabric layer is configured to contact a head of a user. The first polyester mesh fabric layer has a plurality of holes extending therethrough. Each of the plurality of holes of the first polyester mesh fabric layer has a first opening size. The moisture activated cooling mesh fabric layer is coupled to the first polyester mesh fabric layer. The moisture activated cooling mesh fabric layer is constructed of substantially 55% nylon yarn and substantially 45% polyester yarn. The second polyester mesh fabric layer is coupled to the moisture activated cooling mesh fabric layer such that the moisture activated cooling mesh fabric layer is disposed between and contacts the first and second polyester mesh fabric layers. The second polyester mesh fabric layer has a plurality of holes extending into the second polyester mesh fabric layer. Each of the plurality of holes of the second polyester mesh fabric layer has a second opening size. The second opening size is smaller than the first opening size.

DETAILED DESCRIPTION

Baseball Style Cap

Figure 1:
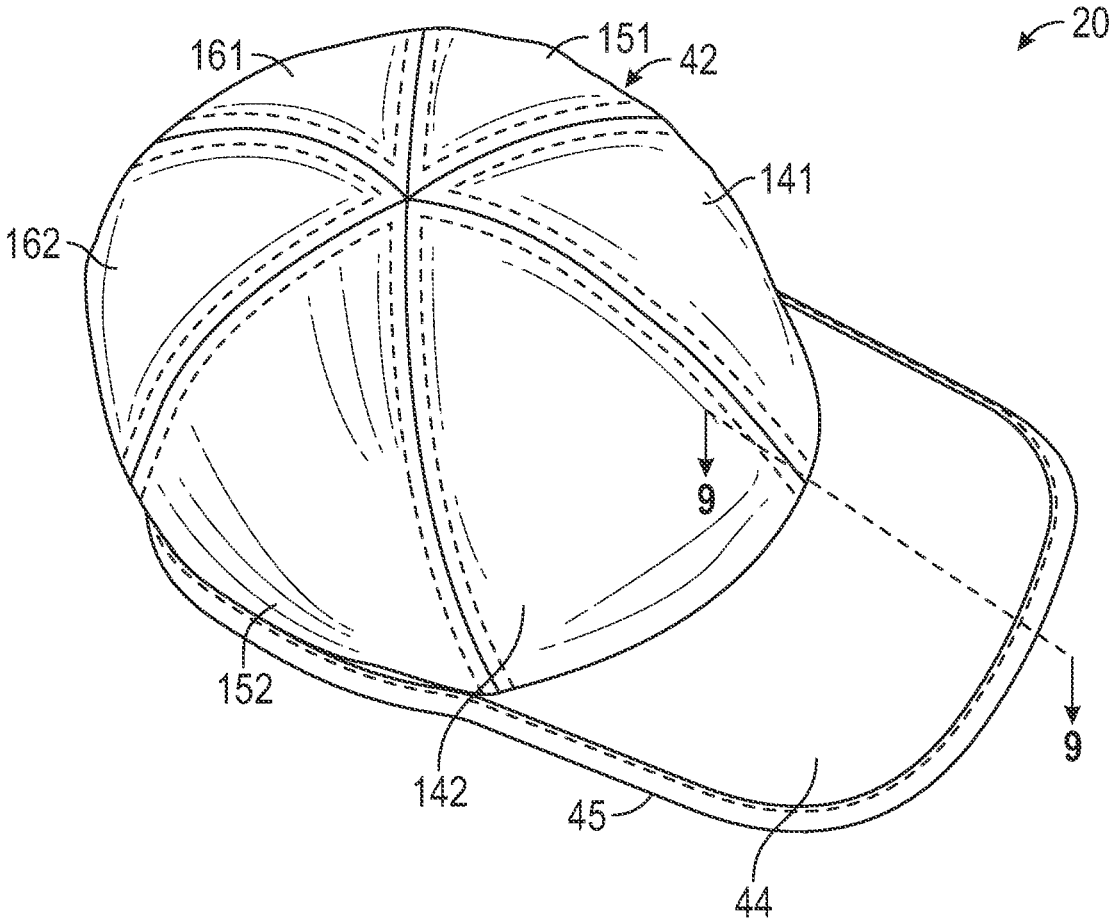
FIG. 1 is a schematic of a baseball style cap in accordance with an exemplary embodiment.
Figure 2:
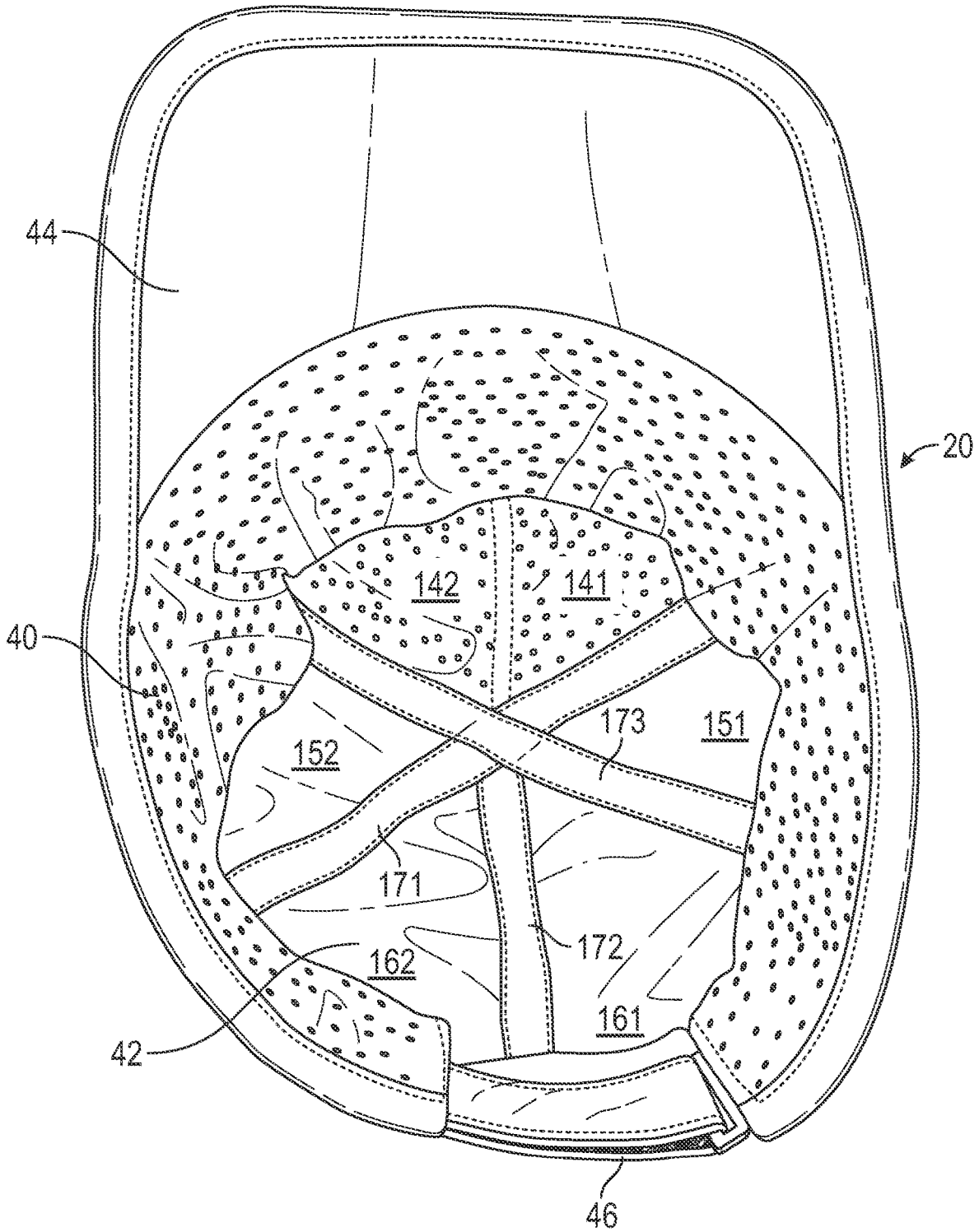
FIG. 2 is a bottom view of the baseball style cap of FIG. 1.
Figure 3:
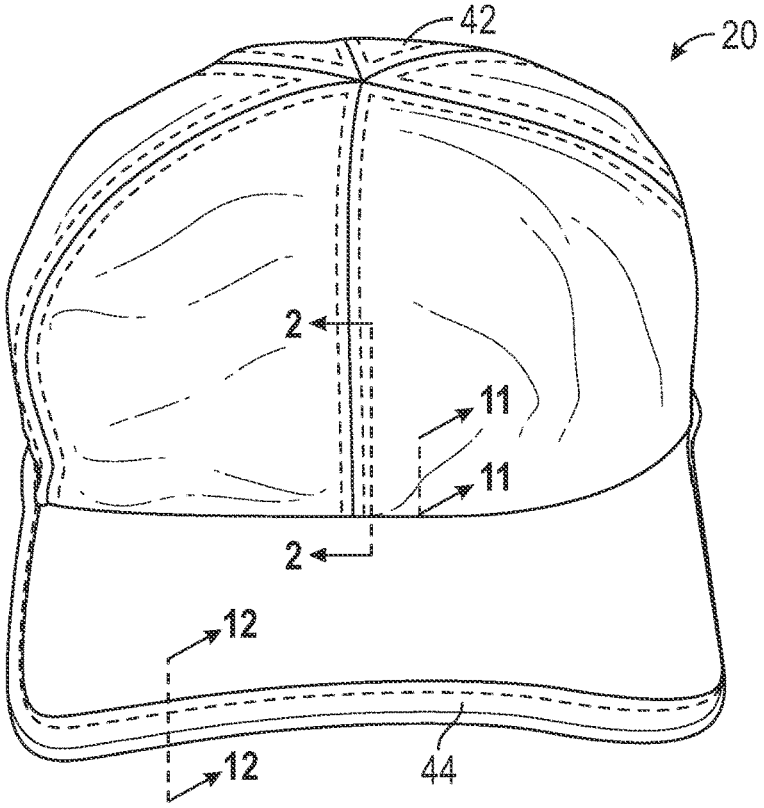
FIG. 3 is a front view of the baseball style cap of FIG. 1.

Referring to FIGS. 1-13, a baseball style cap 20 that is configured to be disposed on the head of user to block sunlight and to capture sweat from the user is illustrated. Referring to FIGS. 1 and 2, the baseball style cap 20 includes a sweatband 40, a crown portion 42, a brim 44, a binding portion 45, and a closure device 46.

The term "substantially" means+−10% of a total amount or a specific number. For example, a value of substantially 100 is a value in a range of 90-110.

Sweatband

Figure 8:
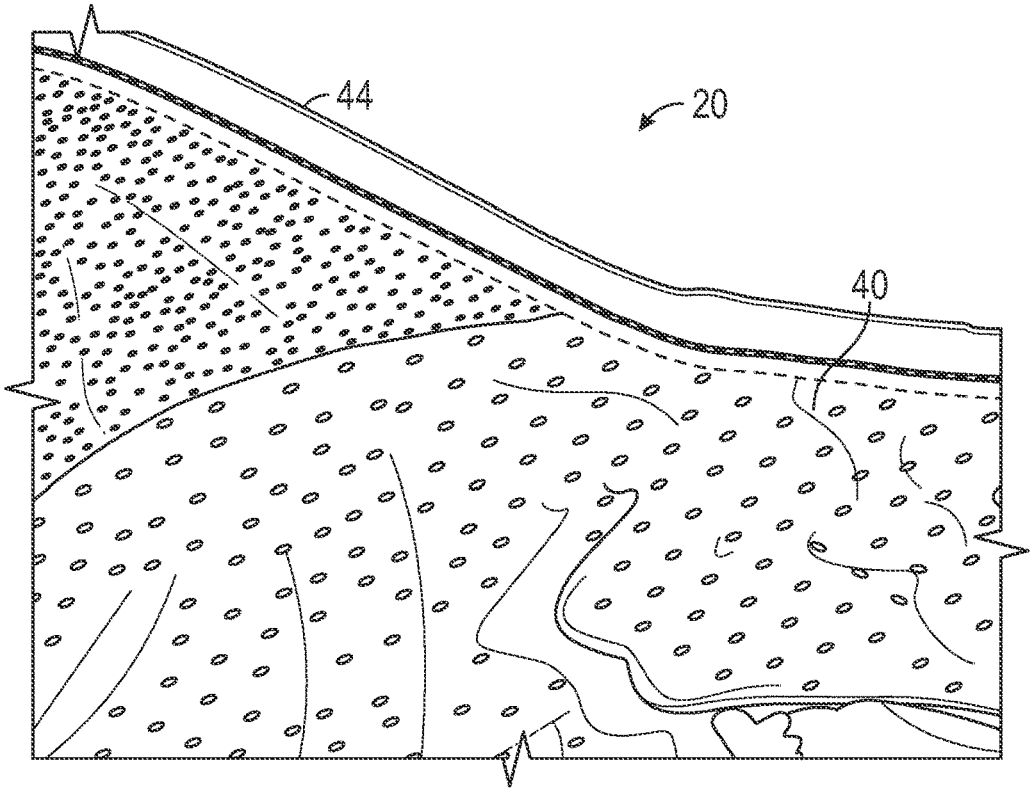
FIG. 8 is an enlarged view of another portion of the baseball style cap of FIG. 1.
Figure 9:
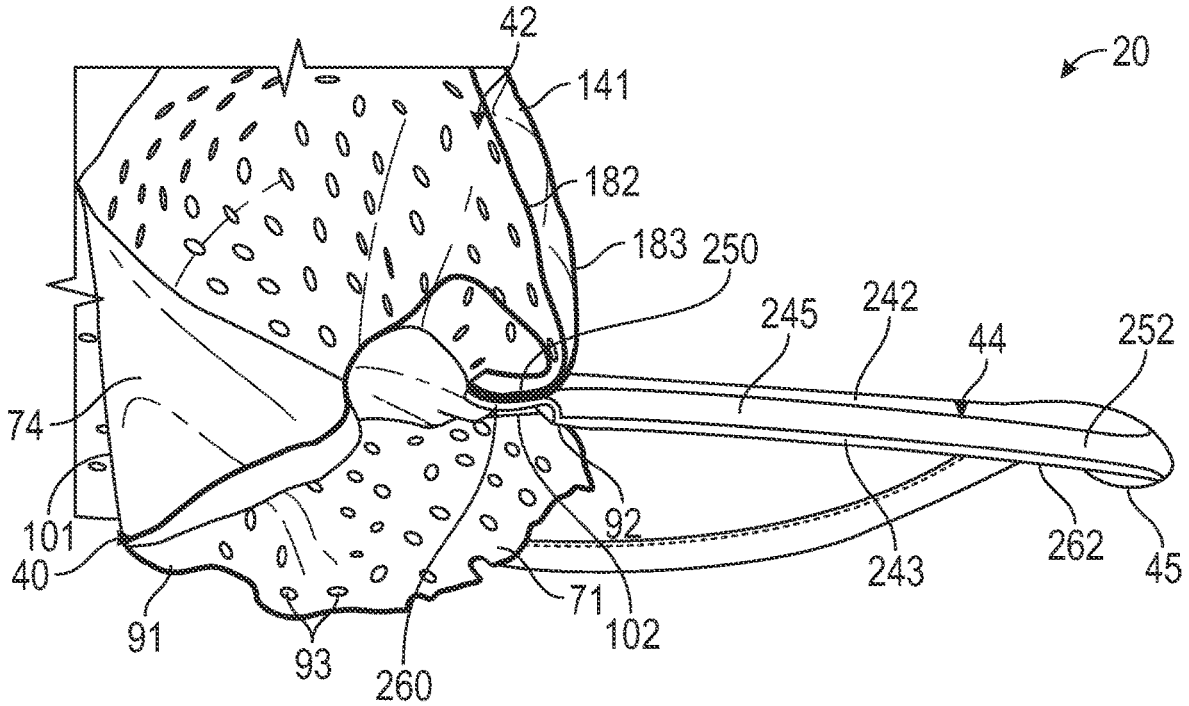
FIG. 9 is a view of layers of a sweatband, a crown portion, and a brim of the baseball style cap of FIG. 1 taken along lines 9-9 in FIG. 1.
Figure 10:
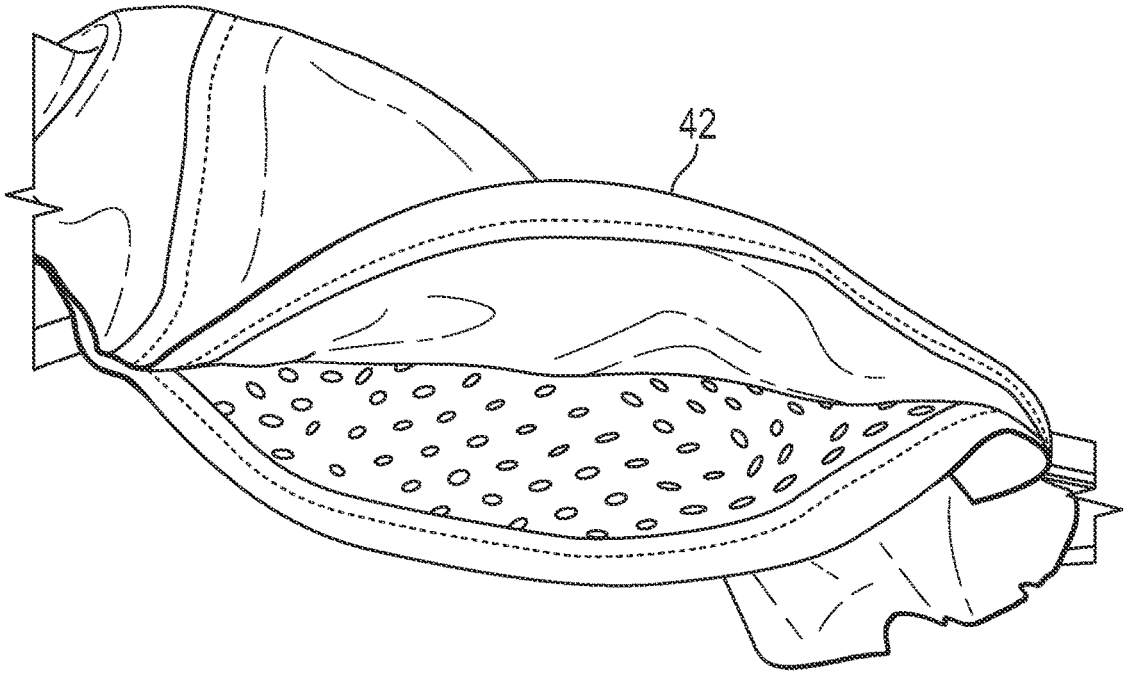
FIG. 10 is a view of fabric layers of a crown portion of the baseball style cap of FIG. 2 taken along lines 2-2 in FIG. 2.

Referring to FIGS. 2, 8 and 9, the sweatband 40 is coupled to the crown portion 42 and is provided to capture sweat from a user. The sweatband 40 includes a polyester mesh fabric layer 71 and a moisture activated cooling mesh fabric layer 74.

The polyester mesh fabric layer 71 is coupled to the moisture activated cooling mesh fabric layer 74 and is configured to contact a head of a user. The polyester mesh fabric layer 71 has a first edge portion 91, a second edge portion 92, and a plurality of holes 93 extending therethrough. Each of the plurality of holes 93 has a first opening size. In an exemplary embodiment, the first opening size has a diameter in a range of 2.5 to 3.5 millimeters which allows a portion of the sweat from a user to quickly propagate through the polyester mesh fabric layer 71 to the moisture activated cooling mesh fabric layer 74. Further, in an exemplary embodiment, the polyester mesh fabric layer 71 is a 100% polyester mesh fabric layer.

The moisture activated cooling mesh fabric layer 74 is coupled to the polyester mesh fabric layer 71 and contacts the crown portion 42 to transfer moisture to the crown portion 42. Referring to FIG. 9, the moisture activated cooling mesh fabric layer 74 includes a first edge portion 101 and a second edge portion 102. The first edge portion 101 is coupled to the first edge portion 91 of the polyester mesh fabric layer 71 utilizing a plurality of stitches extending therethrough. The second edge portion 102 is coupled to the second edge portion 92 of the polyester mesh fabric layer 71 utilizing a plurality of stitches extending therethrough.

The moisture activated cooling mesh fabric layer 74 is constructed of substantially 55% nylon yarn and substantially 45% polyester yarn. In an exemplary embodiment, the moisture activated cooling mesh fabric layer 74 is manufactured by Dongguan Xinlang Textile Technology Co., Ltd. having a business address of 3rd Floor, No. 1, 2nd Road, Bomei Longdi Industrial Zone, Humen Town, Dongguan City, Guangdong Province, China and a website https://xinlangtextile.en.alibaba.com and has a product SKU of XLAB0043NA which is constructed of substantially 55% nylon cold yarn and substantially 45% polyester cold yarn. Nylon cold yarn wicks away moisture from a wearer and provides a cooling sensation to the wearer. Further, polyester cold yarn wicks away moisture from a wearer and provides a cooling sensation to the wearer.

The moisture activated cooling mesh fabric layer 74 was tested by Intertek Testing Services Shenzhen Ltd. having an address of Room 801/901, No. 8, East Bao Ying Road, Huangpu District, Guangzhou, China—and an internet address of intertek.com. The tests performed by Intertek Testing Services Shenzhen Ltd indicated that moisture activated cooling mesh fabric layer 74 has a surface water absorption of 8 milli-liters in a 1 meter by 1 meter area of the moisture activated cooling mesh fabric layer 74. Further, the moisture activated cooling mesh fabric layer 74 has a maximum heat transfer coefficient of 0.135 Watts/$cm^2$ such that heat energy is effectively conducted away from the head of the user—which is greater than other fabrics. Also, the moisture activated cooling mesh fabric layer 74 has a wicking rate in a range of 3.3 millimeters/second to 4.0 millimeters/second such that moisture is wicked away from the head of the user.

In summary, the moisture activated cooling mesh fabric layer 74 has a surface water absorption that is greater than other fabrics which allows the sweatband 40 to desirably absorb more moisture from the head of a user than other sweatbands. Further, the fabric layer 74 has a maximum heat transfer coefficient that is greater than other fabrics which allows the sweatband 74 to conduct more heat energy away from the head of the user than other sweatbands to more effectively cool the head of the user. Further, the fabric layer 74 has a wicking rate that is greater than other fabrics which allows the sweatband 74 to move the moisture more effectively from the head of the user to the crown portion 42 of the baseball style cap 20 for evaporation therefrom. During use, the moisture activated cooling mesh fabric layer 74 has a capillary-like structure that absorbs sweat from the layer 71 and circulates moisture throughout the layer 74 and regulates the evaporation rate and releases water vapor molecules into the air to produce a cooling effect of the user.

Crown Portion

Referring to FIGS. 1 and 2, the crown portion 42 is provided to cover the head of the user. The crown portion 42 includes front panel portions 141, 142, side panel portions 151, 152, rear panel portions 161, 162, and inner taping portions 171, 172, 173.

Figure 11:
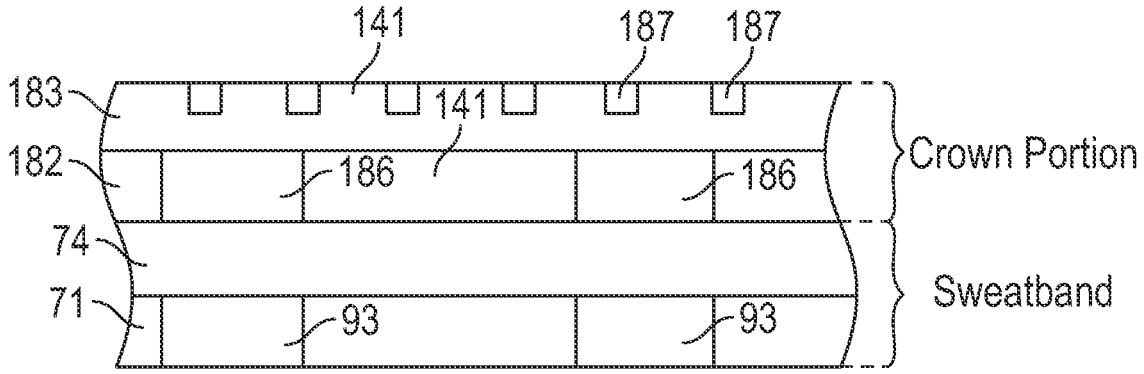
FIG. 11 is an enlarged simplified cross-sectional view of a crown portion and a sweatband in the baseball style cap of FIG. 3 taken along lines 11-11 in FIG. 3.

Referring to FIGS. 1, 2 and 11, the front panel portion 141 is coupled to and between the side panel portion 151 and the front panel portion 142 utilizing the inner taping portions 171, 172, respectively. The front panel portion 141 includes a polyester mesh fabric layer 182 and a polyester mesh fabric layer 183.

Referring to FIG. 11, the polyester mesh fabric layer 182 contacts the moisture activated cooling mesh fabric layer 74 and absorbs moisture therefrom. The polyester mesh fabric layer 182 has a plurality of holes 186 extending therethrough. Each of the plurality of holes of the polyester mesh fabric layer has a first opening size. In an exemplary embodiment, the first opening size has a diameter in a range of 2.5 to 3.5 millimeters which allows a portion of the sweat from a user to quickly propagate through the polyester mesh fabric layer 182 to the polyester mesh fabric layer 183. Further, in an exemplary embodiment, the polyester mesh fabric layer 182 is a 100% polyester mesh fabric layer.

The polyester mesh fabric layer 183 is coupled to the polyester mesh fabric layer 182 utilizing a plurality of stitches extending therethrough. The polyester mesh fabric layer 183 has a plurality of holes 187 extending into the polyester mesh fabric layer 183 but not through the layer 183. Each of the plurality of holes 187 has a second opening size which is smaller than the first opening size of the plurality of holes 186. In an exemplary embodiment, the second opening size has a diameter in a range of 1.2 to 2.0 millimeters which allows a greater outer surface area of the layer 183 which allows sweat to more readily evaporate therefrom. Further, in an exemplary embodiment, the polyester mesh fabric layer 183 is a 100% polyester mesh fabric layer.

The front panel portion 142 contacts the moisture activated cooling mesh fabric layer 74 of the sweatband 40 and absorbs moisture therefrom. The front panel portion 142 is coupled to and between the front panel portion 141 and the side panel portion 152 utilizing the inner taping portions 172, 173, respectively. The structure of the front panel portion 142 is substantially similar to the front panel portion 141 and includes a pair of polyester mesh fabric layers.

The side panel portion 152 contacts the moisture activated cooling mesh fabric layer 74 of the sweatband 40 and absorbs moisture therefrom. The side panel portion 152 is coupled to and between the front panel portion 142 and the rear panel portion 162 utilizing the inner taping portions 173, 171, respectively. The side panel portion 152 has a single polyester mesh fabric layer having a structure similar to the polyester mesh fabric layer 183.

The rear panel portion 162 contacts the moisture activated cooling mesh fabric layer 74 of the sweatband 40 and absorbs moisture therefrom. The rear panel portion 162 is coupled to and between the side panel portion 152 and the rear panel portion 161 utilizing the inner taping portions 171, 172, respectively. The structure of the rear panel portion 162 is similar to the side panel portion 152 and includes a single polyester mesh fabric layer having a structure similar to the polyester mesh fabric layer 183, except that the rear panel portion 162 includes a cut-out portion 194 (shown in FIG. 4).

The rear panel portion 161 contacts the moisture activated cooling mesh fabric layer 74 of the sweatband 40 and absorbs moisture therefrom. The rear panel portion 161 is coupled to and between the rear panel portion 162 and the side panel portion 151 utilizing the inner taping portions 172, 173, respectively. The structure of the rear panel portion 161 is similar to the side panel portion 152 and includes a single polyester mesh fabric layer having a structure similar to the polyester mesh fabric layer 183, except that the rear panel portion 161 includes a cut-out portion 196 (shown in FIG. 4).

The side panel portion 151 contacts the moisture activated cooling mesh fabric layer 74 of the sweatband 40 and absorbs moisture therefrom. The side panel portion 151 is coupled to and between the rear panel portion 161 and the front panel portion 141 utilizing the inner taping portions 173, 171, respectively. The structure of the side panel portion 151 is similar to the side panel portion 152 and includes a single polyester mesh fabric layer having a structure similar to the polyester mesh fabric layer 183.

In an alternate embodiment, the side panel portion 152, the rear panel portion 162, the rear panel portion 161, and the side panel portion 151 each have a structure similar to the front panel portion 141 and include a pair of polyester mesh fabric layers.

Brim

Referring to FIGS. 1, 2, and 9, the brim 44 is coupled to and extends from the crown portion 42. The brim 44 includes a polyester mesh fabric layer 242, a polyester mesh fabric layer 243, and a central plastic portion 245.

Figure 12:
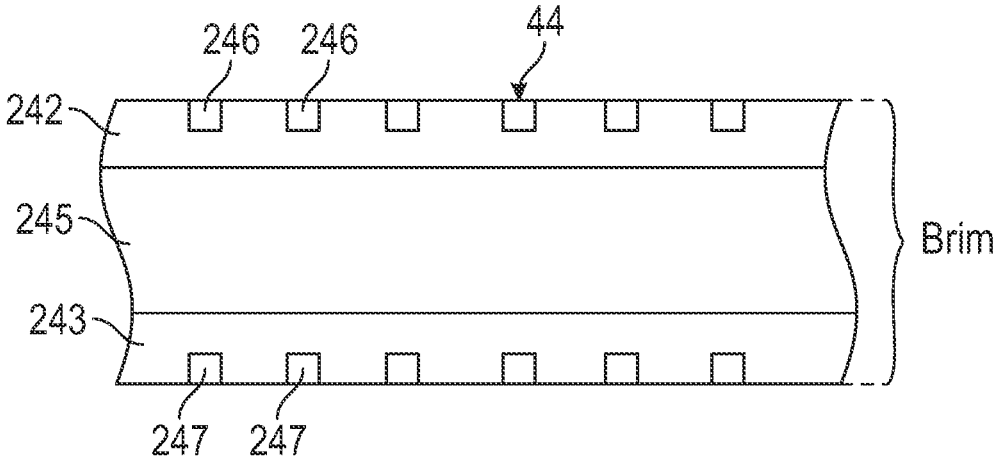
FIG. 12 is an enlarged simplified cross-sectional view of a brim in the baseball style cap of FIG. 3 taken along lines 12-12 in FIG. 3.

Referring to FIGS. 9 and 12, the polyester mesh fabric layer 242 is disposed on a top surface of the central plastic portion 254. The polyester mesh fabric layer 242 has a plurality of holes 246 extending into the polyester mesh fabric layer 242 but not through the layer 242. Further, the polyester mesh fabric layer 242 has an inner edge portion 250 and an outer edge portion 252. Each of the plurality of holes 246 has a second opening size which is smaller than the first opening size of the plurality of holes 186. In an exemplary embodiment, the second opening size has a diameter in a range of 1.2 to 2.0 millimeters which provides a greater outer surface area of the layer 242 which allows sweat to more readily evaporate therefrom. The inner edge portion 250 is coupled to the crown portion 42 utilizing a plurality of stitches. The outer edge portion 252 is coupled to the binding portion 45 which is wrapped over a portion of the central plastic portion 245 utilizing a plurality of stitches. Further, in an exemplary embodiment, the polyester mesh fabric layer 242 is a 100% polyester mesh fabric layer.

The polyester mesh fabric layer 243 is disposed on a bottom surface of the central plastic portion 254. The polyester mesh fabric layer 243 has a plurality of holes 247 extending into the polyester mesh fabric layer 243 but not through the layer 243. Further, the polyester mesh fabric layer 243 has an inner edge portion 260 and an outer edge portion 262. Each of the plurality of holes 247 has a second opening size which is smaller than the first opening size of the plurality of holes 186. In an exemplary embodiment, the second opening size has a diameter in a range of 1.2 to 2.0 millimeters which provides a greater outer surface area of the layer 243 which allows sweat to more readily evaporate therefrom. The inner edge portion 260 is coupled to the crown portion 42 utilizing a plurality of stitches. The outer edge portion 262 is coupled to the binding portion 45 which is wrapped over a portion of the central plastic portion 245 utilizing a plurality of stitches. Further, in an exemplary embodiment, the polyester mesh fabric layer 243 is a 100% polyester mesh fabric layer.

The central plastic portion 254 is coupled to the crown portion 42 utilizing the polyester mesh fabric layer 242, the polyester mesh fabric layer 243, and the binding portion 45.

Figure 4:
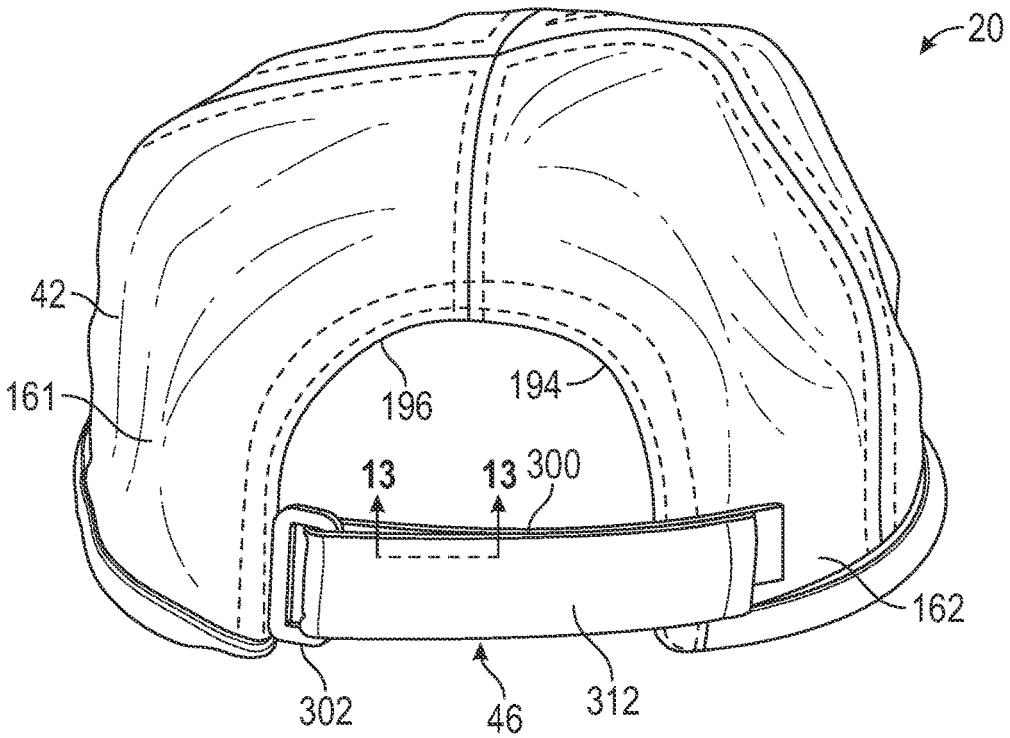
FIG. 4 is a rear view of the baseball style cap of FIG. 1.
Figure 5:
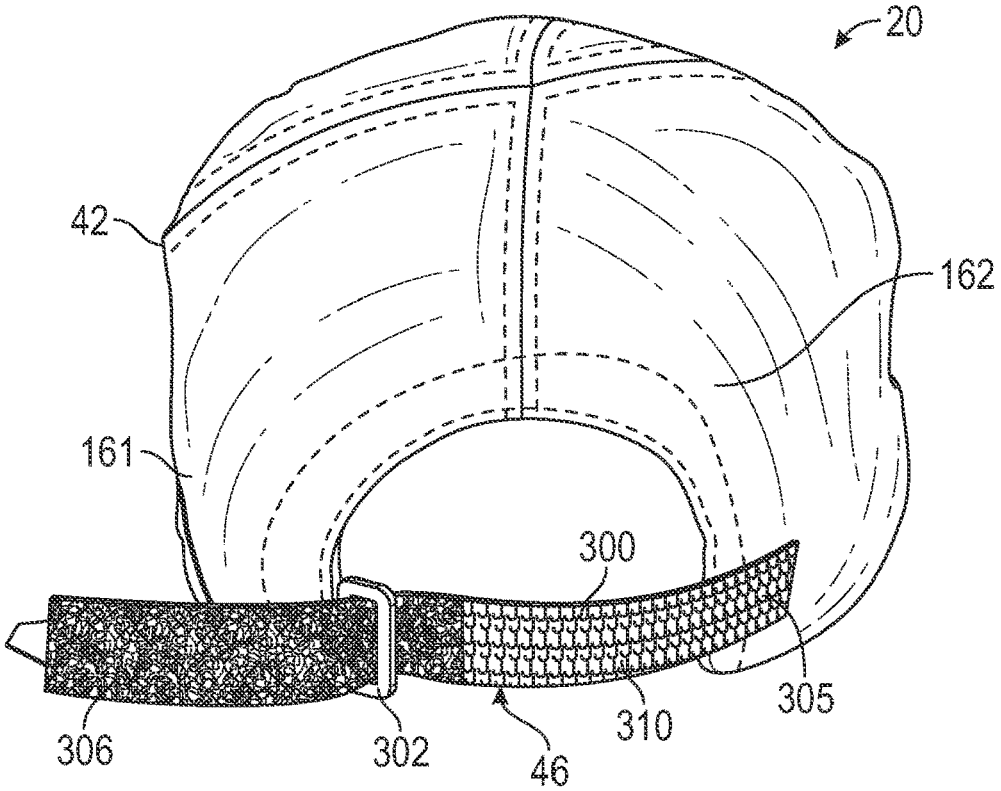
FIG. 5 is another rear view of the baseball style cap of FIG. 1.
Figure 6:
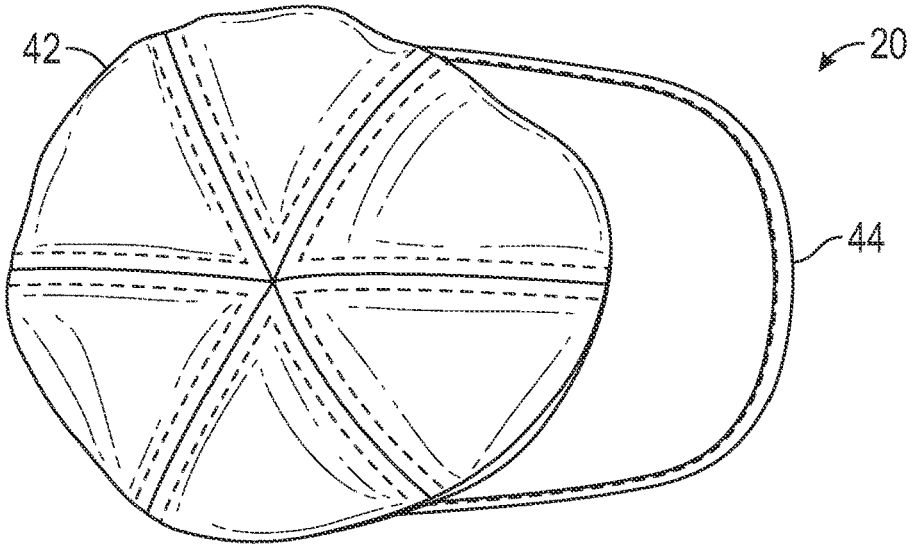
FIG. 6 is a top view of the baseball style cap of FIG. 1.
Figure 7:
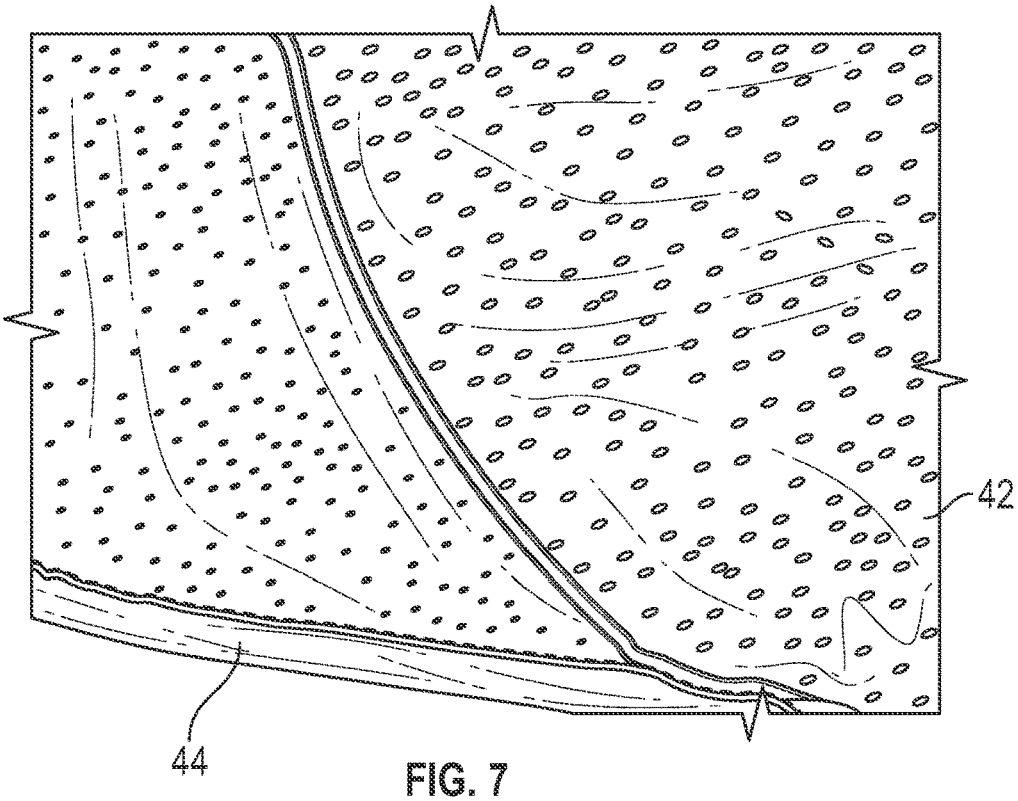
FIG. 7 is an enlarged view of a portion of the baseball style cap of FIG. 1.
Figure 13:
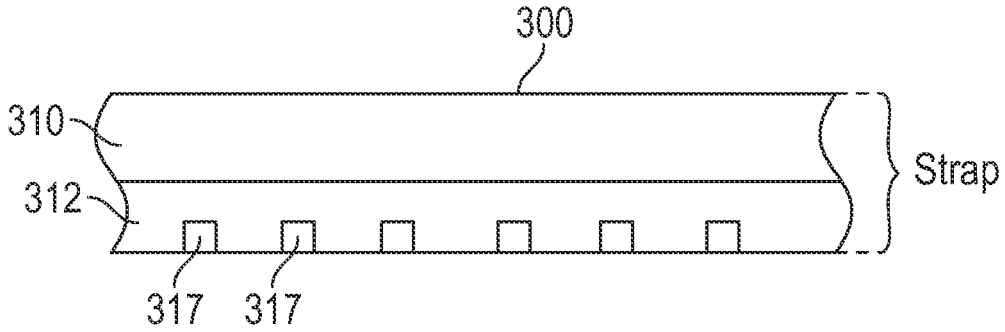
FIG. 13 is an enlarged simplified cross-sectional view of a strap in the baseball style cap of FIG. 4 taken along lines 13-13 in FIG. 4.

Referring to FIGS. 4, 5 and 13, the closure device 46 is utilized to adjust an effective diameter of the crown portion 42 for holding the crown portion 42 on the head of the user. The closure device 46 includes a strap 300 and a buckle 302. The strap 300 has a first end 305 and a second end 306. The buckle 302 is coupled to the rear panel portion 161. The first end 305 of the strap 300 is coupled to the rear panel portion 162. The second end 306 extends through the buckle 302 and is further removably attached to the strap 300. Referring to FIG. 13, the strap 300 comprises a velcro layer 310 and a polyester mesh layer 312 coupled together and disposed on one another. The polyester mesh layer 312 has a plurality of holes 317 extending into the polyester mesh fabric layer 312 but not through the layer 312. Each of the plurality of holes 317 has a second opening size which is smaller than the first opening size of the plurality of holes 186. In an exemplary embodiment, the second opening size has a diameter in a range of 1.2 to 2.0 millimeters which provides a greater outer surface area of the layer 312 which allows sweat to more readily evaporate therefrom. Further, in an exemplary embodiment, the polyester mesh fabric layer 312 is a 100% polyester mesh fabric layer.

Sun Visor Cap

Referring to FIGS. 14-22, a sun visor cap 420 is configured to be disposed on the head of user to block sunlight and to capture sweat from the user is illustrated. The sun visor cap 420 includes a sweatband 440, a brim 444, binding portions 445, 446, and a closure device 450.

Sweatband

Figure 14:
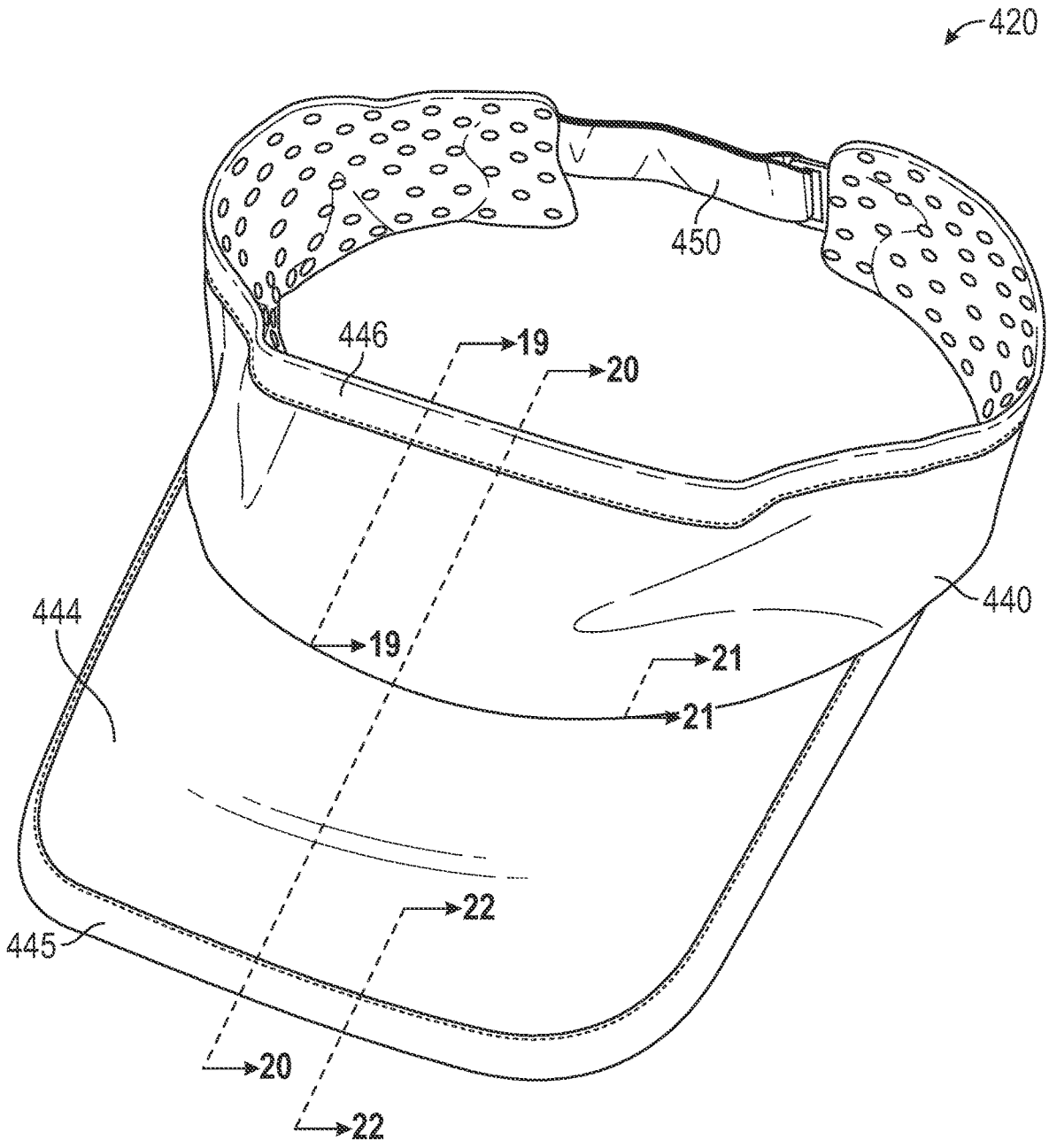
FIG. 14 is a schematic of a sun visor cap in accordance with another exemplary embodiment.
Figure 15:
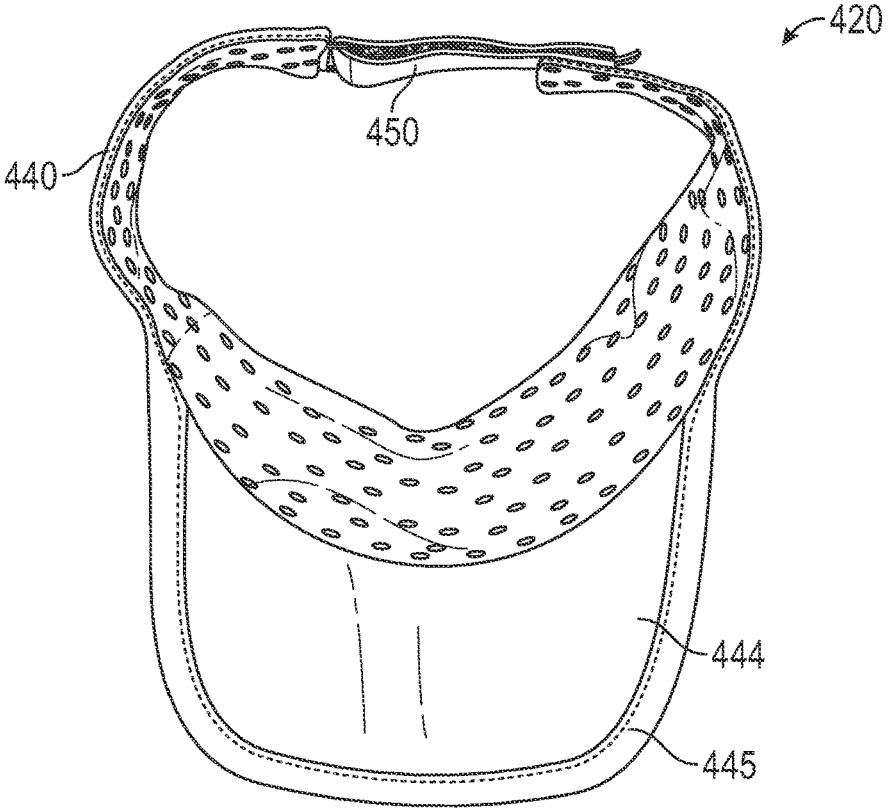
FIG. 15 is a bottom view of the sun visor cap of FIG. 14.
Figure 16:
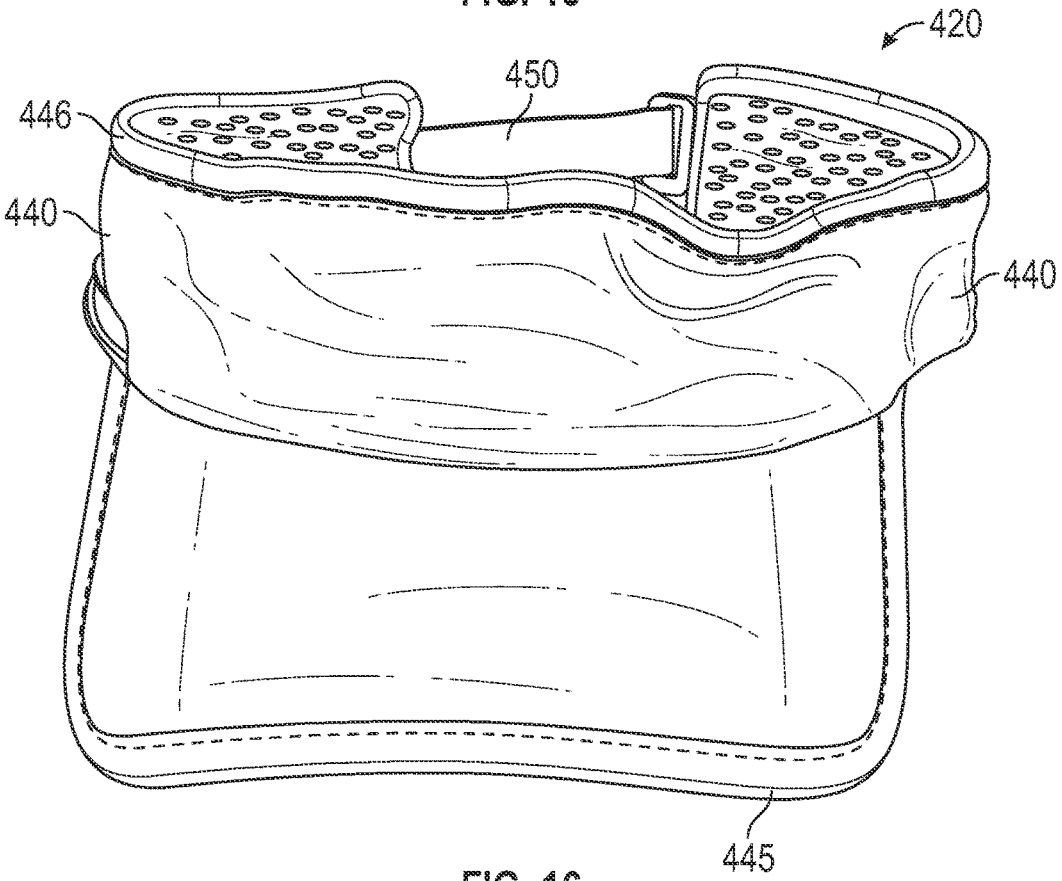
FIG. 16 is a front view of the sun visor cap of FIG. 14.
Figure 20:
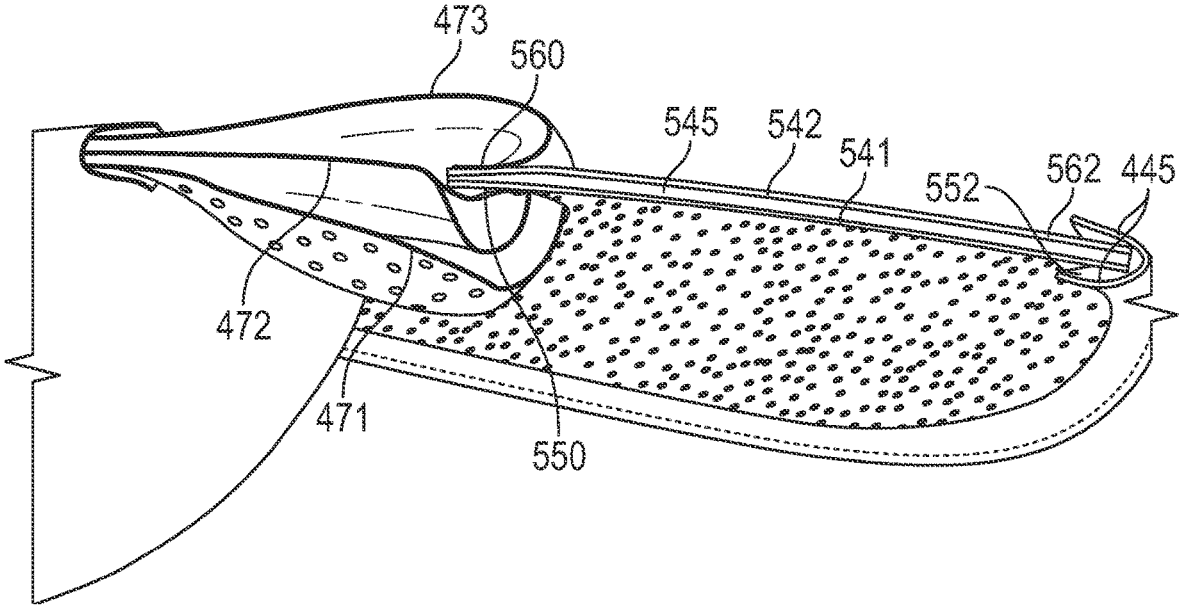
FIG. 20 is a view of layers of a brim of the sun visor cap of FIG. 14 taken along lines 20-20 in FIG. 14.
Figure 21:
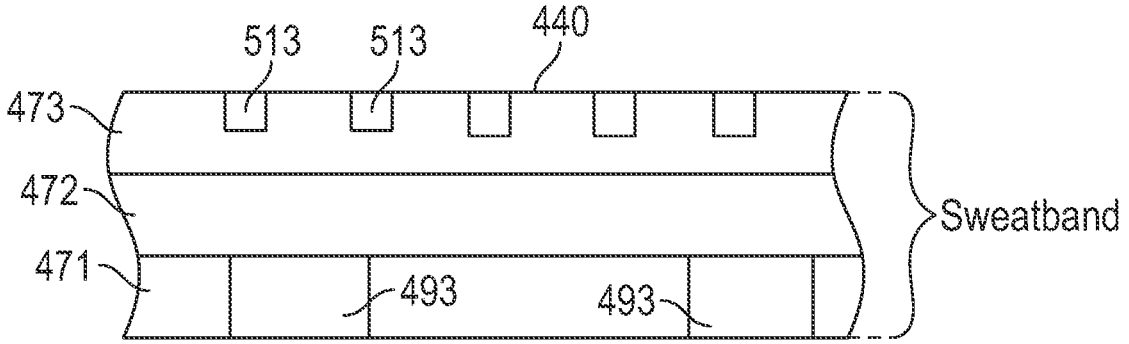
FIG. 21 is an enlarged simplified cross-sectional view of a sweatband in the sun visor cap of FIG. 14 taken along lines 21-21 in FIG. 14.

Referring to FIGS. 14, 20 and 21, the sweatband 440 is coupled to the brim 444 and is provided to capture sweat from a user. The sweatband 440 includes a polyester mesh fabric layer 471, a moisture activated cooling mesh fabric layer 472, and a polyester mesh fabric layer 473.

Figure 19:
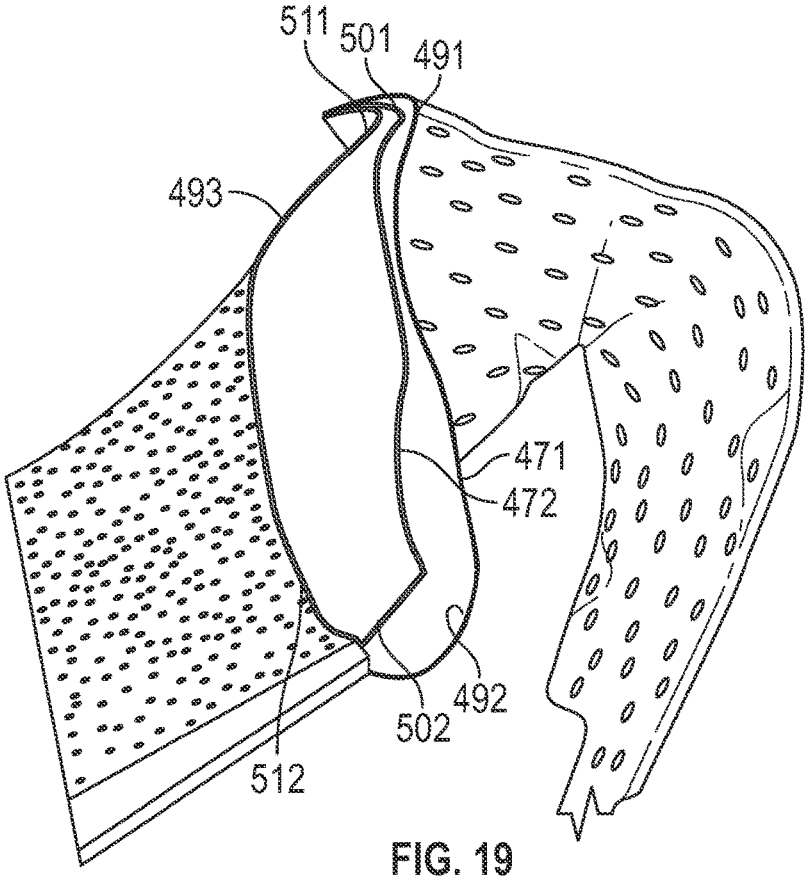
FIG. 19 is a view of fabric layers of a sweatband of the sun visor cap of FIG. 14 taken along lines 19-19 in FIG. 14.

Referring to FIGS. 19 and 21, the polyester mesh fabric layer 471 is coupled to and contacts the moisture activated cooling mesh fabric layer 472 and is configured to contact a head of a user. The polyester mesh fabric layer 471 has a first edge portion 491, a second edge portion 492, and a plurality of holes 493 extending therethrough. Each of the plurality of holes 493 has a first opening size. In an exemplary embodiment, the first opening size has a diameter in a range of 2.5 to 3.5 millimeters which allows a portion of the sweat from a user to quickly propagate through the polyester mesh fabric layer 471 to the moisture activated cooling mesh fabric layer 472. Further, in an exemplary embodiment, the polyester mesh fabric layer 471 is a 100% polyester mesh fabric layer.

The moisture activated cooling mesh fabric layer 472 is coupled to and between the polyester mesh fabric layer 471 and the polyester mesh fabric layer 473. The moisture activated cooling mesh fabric layer 472 includes a first edge portion 501 and a second edge portion 502. The first edge portion 501 is coupled to the first edge portion 491 of the polyester mesh fabric layer 471 utilizing a plurality of stitches extending therethrough. The second edge portion 502 is coupled to the second edge portion 492 of the polyester mesh fabric layer 471 utilizing a plurality of stitches extending therethrough.

The moisture activated cooling mesh fabric layer 472 is constructed of substantially 55% nylon yarn and substantially 45% polyester yarn. In an exemplary embodiment, the moisture activated cooling mesh fabric layer 472 is manufactured by Dongguan Xinlang Textile Technology Co., Ltd. having a business address of 3rd Floor, No. 1, 2nd Road, Bomei Longdi Industrial Zone, Humen Town, Dongguan City, Guangdong Province, China and a website https://xinlangtextile.en.alibaba.com and has a product SKU of XLAB0043NA which is constructed of substantially 55% nylon cold yarn and substantially 45% polyester cold yarn. Nylon cold yarn wicks away moisture from a wearer and provides a cooling sensation to the wearer. Further, polyester cold yarn wicks away moisture from a wearer and provides a cooling sensation to the wearer.

The moisture activated cooling mesh fabric layer 472 was tested by Intertek Testing Services Shenzhen Ltd. having an address of Room 801/901, No. 8, East Bao Ying Road, Huangpu District, Guangzhou, China—and an internet address of intertek.com. The tests performed by Intertek Testing Services Shenzhen Ltd indicated that moisture activated cooling mesh fabric layer 472 has a surface water absorption of 8 milli-liters in a 1 meter by 1 meter area of the moisture activated cooling mesh fabric layer 472. Further, the moisture activated cooling mesh fabric layer 472 has a maximum heat transfer coefficient of 0.135 Watts/$cm^2$ such that heat energy is effectively conducted away from the head of the user—which is greater than other fabrics. Also, the moisture activated cooling mesh fabric layer 472 has a wicking rate in a range of 3.3 millimeters/second to 4.0 millimeters/second such that moisture is wicked away from the head of the user.

In summary, the moisture activated cooling mesh fabric layer 472 has a surface water absorption that is greater than other fabrics which allows the sweatband 440 to desirably absorb more moisture from the head of a user than other sweatbands. Further, the fabric layer 472 has a maximum heat transfer coefficient that is greater than other fabrics which allows the sweatband 440 to conduct more heat energy away from the head of the user than other sweatbands to more effectively cool the head of the user. Further, the fabric layer 472 has a wicking rate that is greater than other fabrics which allows the sweatband 440 to move the moisture more effectively from the head of the user for evaporation therefrom. During use, the moisture activated cooling mesh fabric layer 472 has a capillary-like structure that absorbs sweat from the layer 471 and circulates moisture throughout the layer 474 and regulates the evaporation rate and releases water vapor molecules into the air to produce a cooling effect of the user.

The polyester mesh fabric layer 473 is coupled to and contacts the moisture activated cooling mesh fabric layer 472. The polyester mesh fabric layer 473 has a first edge portion 511, a second edge portion 512, and a plurality of holes 513 extending therethrough. Each of the plurality of holes 513 has a first opening size. In an exemplary embodiment, the first opening size has a diameter in a range of 2.5 to 3.5 millimeters which provides a larger evaporation region on the exterior of the polyester mesh fabric layer 473 to evaporate the moisture. Further, in an exemplary embodiment, the polyester mesh fabric layer 473 is a 100% polyester mesh fabric layer.

Brim

Figure 22:
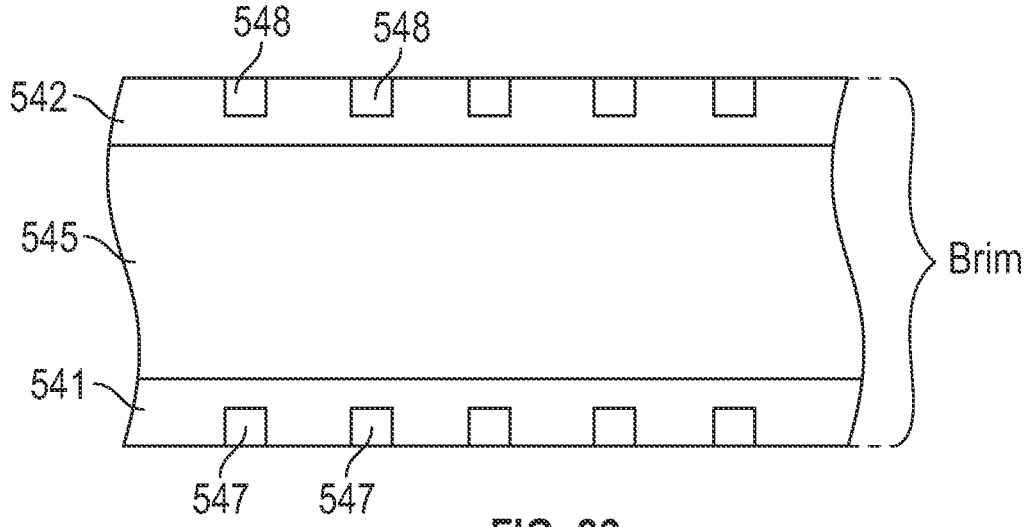
FIG. 22 is an enlarged simplified cross-sectional view of a brim in the sun visor cap of FIG. 14 taken along lines 22-22 in FIG. 14.

Referring to FIGS. 14, 20 and 22, the brim 444 is coupled to and extends from the sweatband 440. The brim 444 includes a polyester mesh fabric layer 541, a polyester mesh fabric layer 542, and a central plastic portion 545.

The polyester mesh fabric layer 541 is disposed on a bottom surface of the central plastic portion 545. The polyester mesh fabric layer 541 has an inner edge portion 550 and an outer edge portion 552. Further, the polyester mesh fabric layer 541 has a plurality of holes 547 extending into the polyester mesh fabric layer 541 but not through the layer 541. Each of the plurality of holes 547 has a second opening size which is smaller than the first opening size of the plurality of holes 493. In an exemplary embodiment, the second opening size has a diameter in a range of 1.2 to 2.0 millimeters which provides a greater outer surface area of the layer 541 which allows sweat to more readily evaporate therefrom. The inner edge portion 550 is coupled to the polyester mesh fabric layer 542 utilizing a plurality of stitches. The outer edge portion 552 is coupled to the binding portion 445 which is wrapped over a portion of the central plastic portion 545. Further, in an exemplary embodiment, the polyester mesh fabric layer 541 is a 100% polyester mesh fabric layer.

The polyester mesh fabric layer 542 is disposed on a top surface of the central plastic portion 545. The polyester mesh fabric layer 542 has an inner edge portion 560 and an outer edge portion 562. Further, the polyester mesh fabric layer 542 has a plurality of holes 548 extending into the polyester mesh fabric layer 542 but not through the layer 542. Each of the plurality of holes 548 has a second opening size which is smaller than the first opening size of the plurality of holes 493. In an exemplary embodiment, the second opening size has a diameter in a range of 1.2 to 2.0 millimeters which provides a greater outer surface area of the layer 542 which allows sweat to more readily evaporate therefrom. The inner edge portion 560 is coupled to the polyester mesh fabric layer 541 utilizing a plurality of stitches. The outer edge portion 562 is coupled to the binding portion 445 which is wrapped over a portion of the central plastic portion 545. Further, in an exemplary embodiment, the polyester mesh fabric layer 542 is a 100% polyester mesh fabric layer.

The central plastic portion 545 is coupled to the sweatband 440 utilizing the polyester mesh fabric layer 541, the polyester mesh fabric layer 542, and the binding portion 445.

Figure 17:
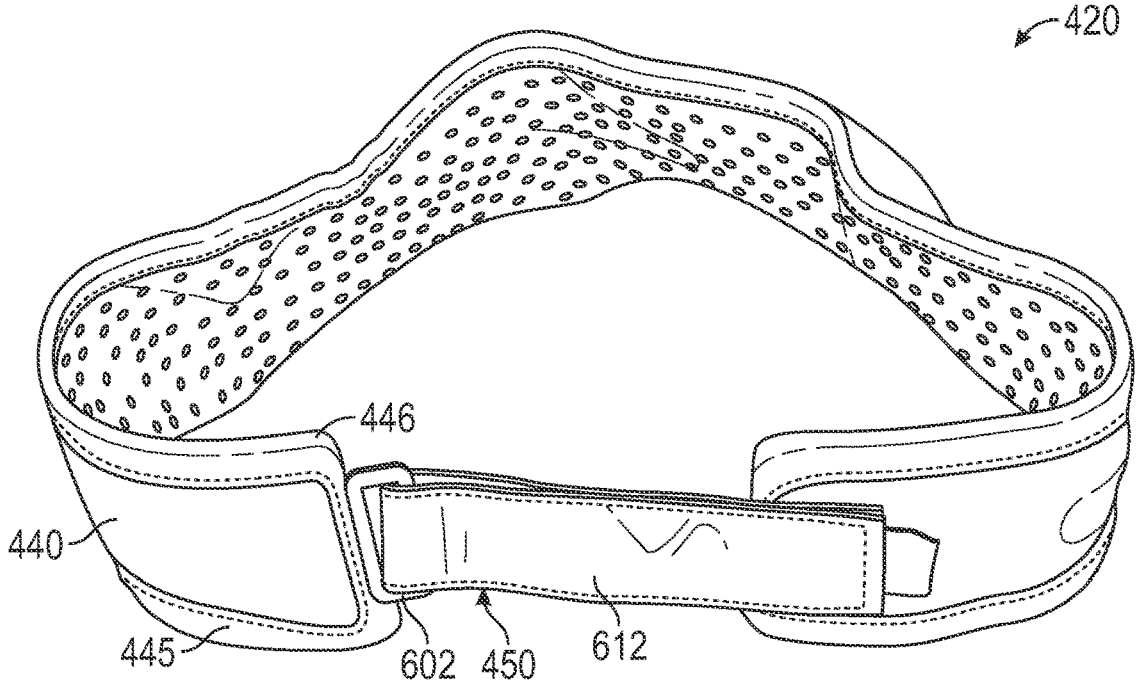
FIG. 17 is a rear view of the sun visor cap of FIG. 14.
Figure 18:
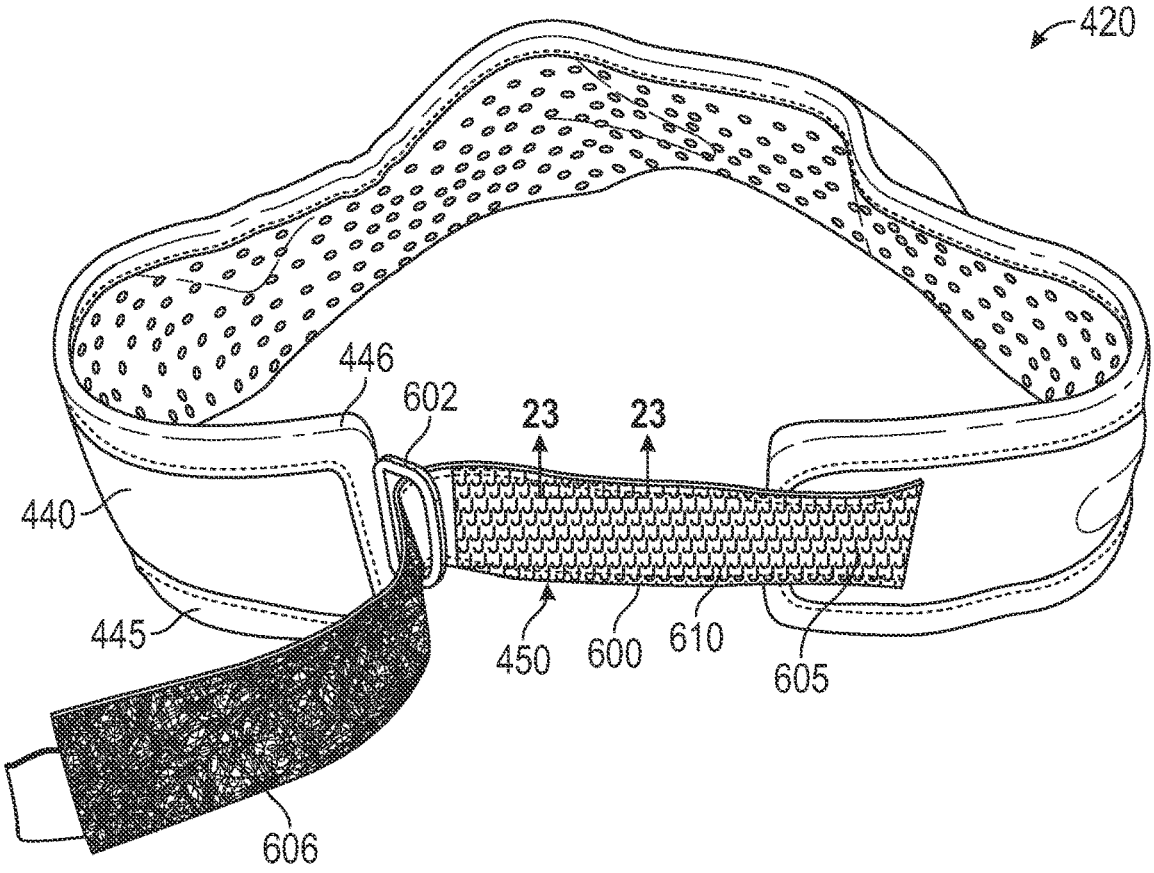
FIG. 18 is another rear view of the sun visor cap of FIG. 14.
Figure 23:
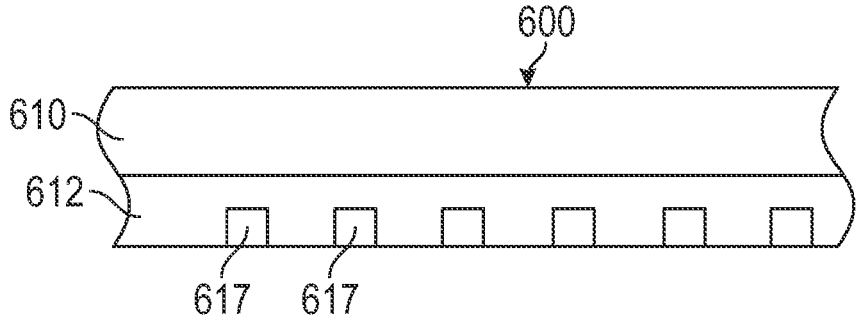
FIG. 23 is an enlarged simplified cross-sectional view of a strap in the sun visor cap of FIG. 18 taken along lines 23-23 in FIG. 18.
Figure 24:
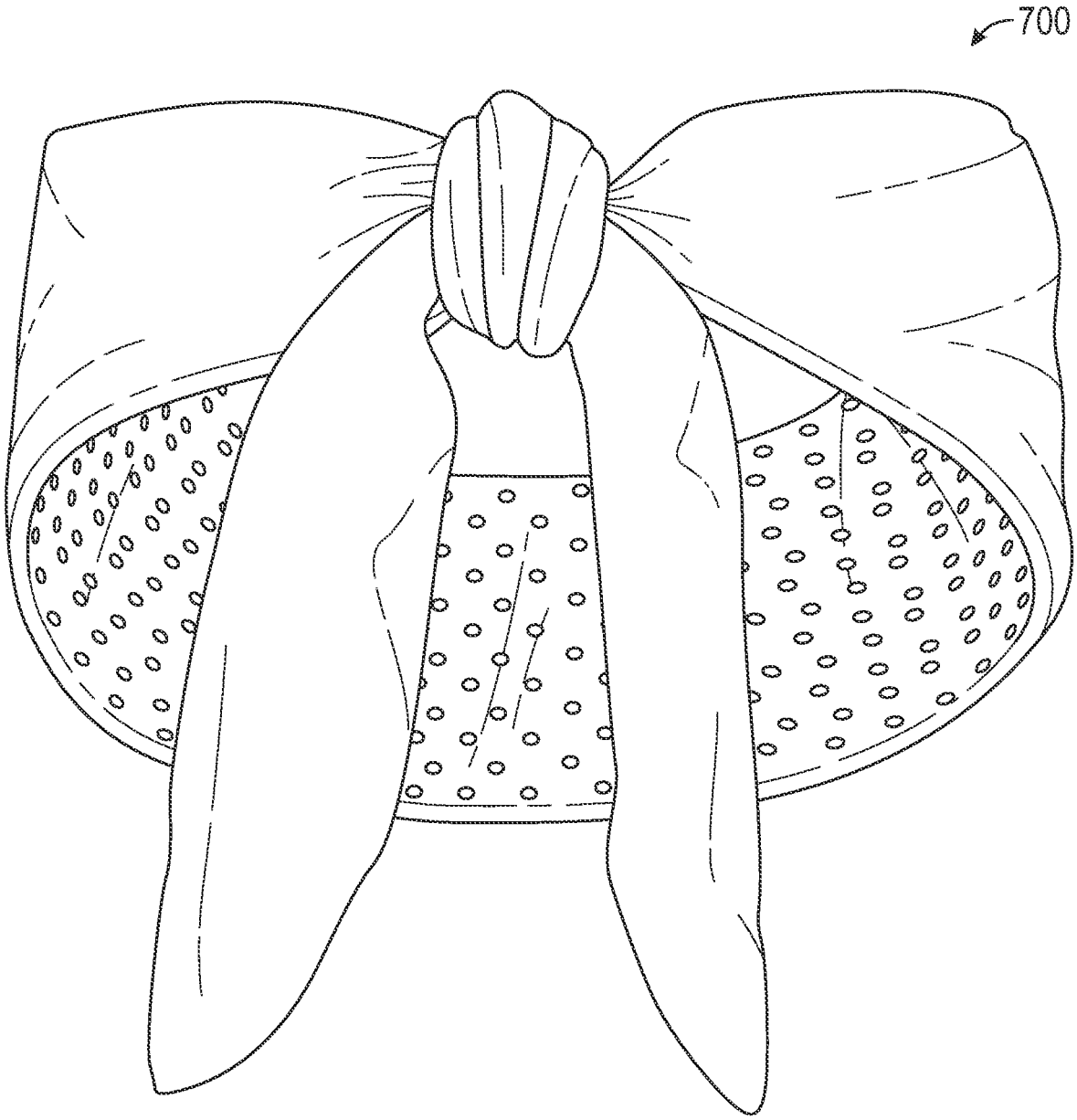
FIG. 24 is a schematic of a gym wrap device in accordance with another exemplary embodiment.

Referring to FIGS. 17, 18, and 23, the closure device 450 is utilized to adjust an effective diameter of the sweatband 440 for holding the sweatband 440 on the head of the user. The closure device 450 includes a strap 600 and a buckle 602. The strap 600 has a first end 605 and a second end 606. The buckle 602 is coupled to a first end of the sweatband 440. The first end 605 of the strap 600 is coupled to a second end of the sweatband 440. The second end 606 of the strap 600 extends through the buckle 602 and is further removably attached to the strap 600. The strap 600 comprises a velcro layer 610 and a polyester mesh layer 612 coupled together and disposed on one another. The polyester mesh layer 612 has a plurality of holes 617 extending into the polyester mesh fabric layer 612 but not through the layer 612. Each of the plurality of holes 617 has a second opening size which is smaller than the first opening size of the plurality of holes 493. In an exemplary embodiment, the second opening size has a diameter in a range of 1.2 to 2.0 millimeters which provides a greater outer surface area of the layer 612 which allows sweat to more readily evaporate therefrom. Further, in an exemplary embodiment, the polyester mesh fabric layer 612 is a 100% polyester mesh fabric layer.

Gym Wrap Device

Figure 25:
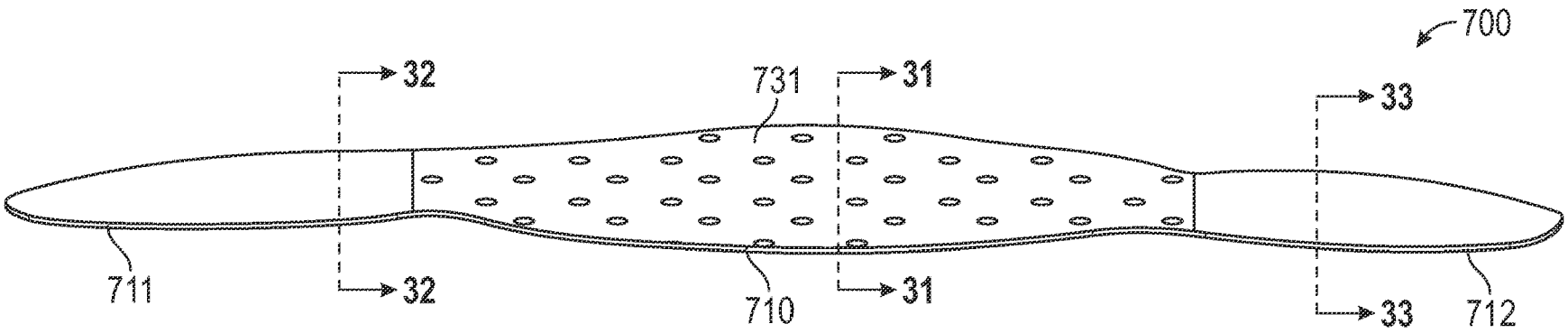
FIG. 25 is a view of a first side of the gym wrap device of FIG. 24.
Figure 26:
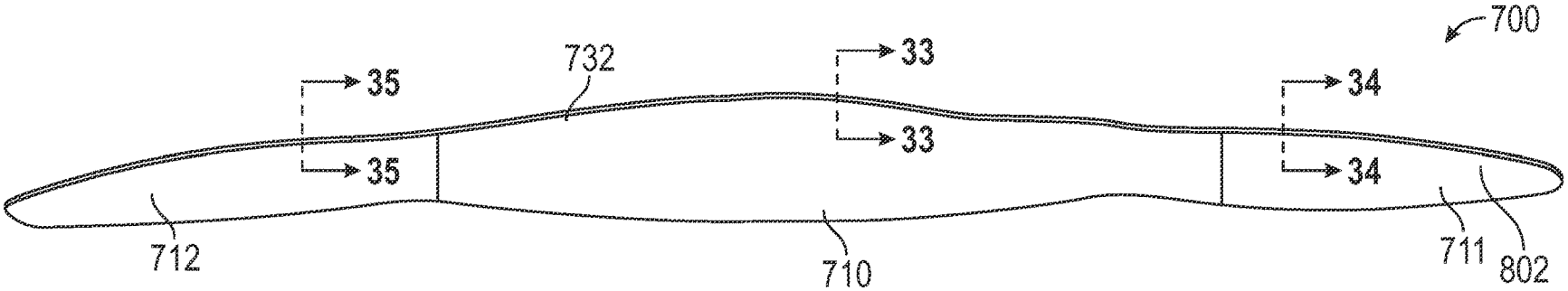
FIG. 26 is a view of a second side of the gym wrap device of FIG. 24.

Referring to FIGS. 24-36, a gym wrap device 700 that is configured to be disposed on the head of a user to capture sweat from the user is illustrated. Referring to FIGS. 25 and 26, the gym wrap device 700 includes a central wrap portion 710, a first end wrap portion 711, a second end wrap portion 712, a first side 731, and a second side 732.

Central Wrap Portion

Figure 27:
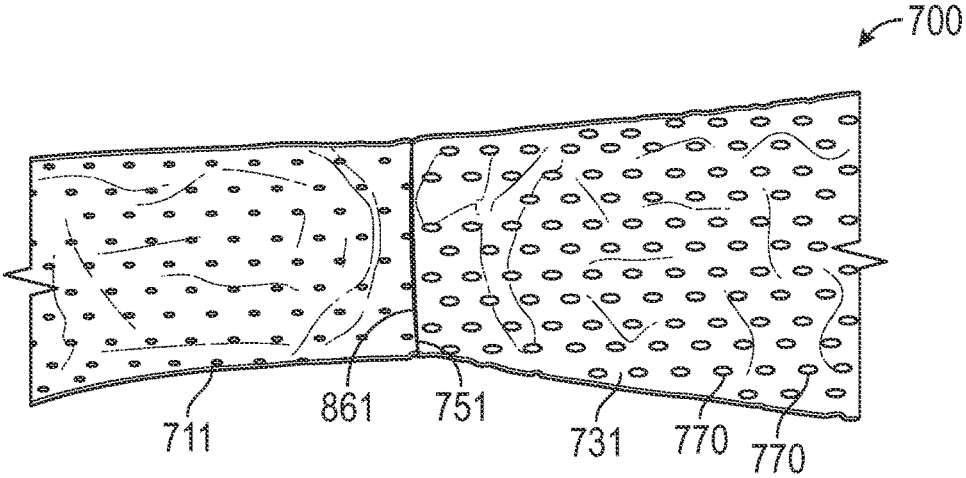
FIG. 27 is an enlarged view of a portion of the first side of the gym wrap device of FIG. 25.
Figure 28:
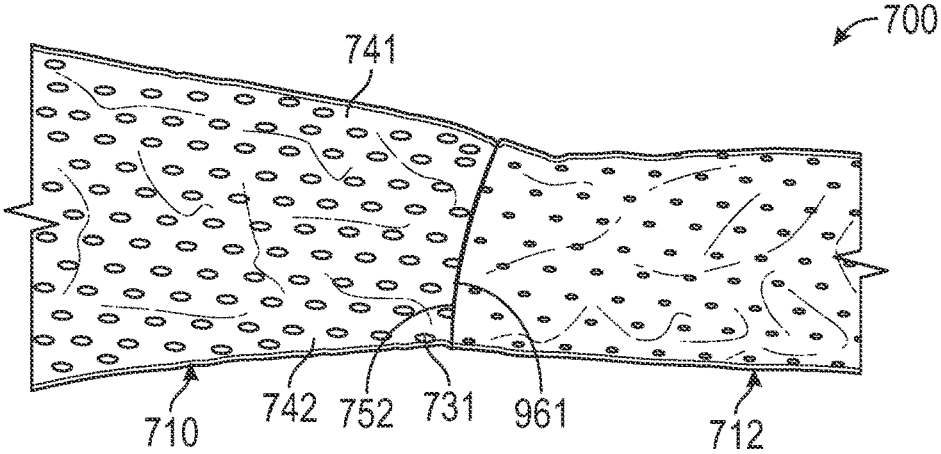
FIG. 28 is an enlarged view of a portion of the first side of the gym wrap device of FIG. 25.
Figure 29:
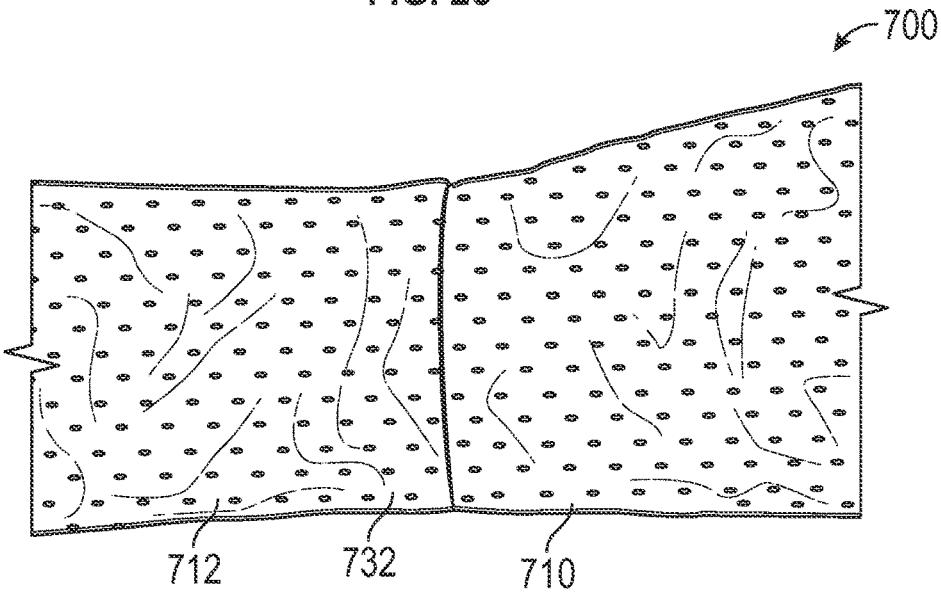
FIG. 29 is an enlarged view of a portion of the second side of the gym wrap device of FIG. 26.
Figure 30:
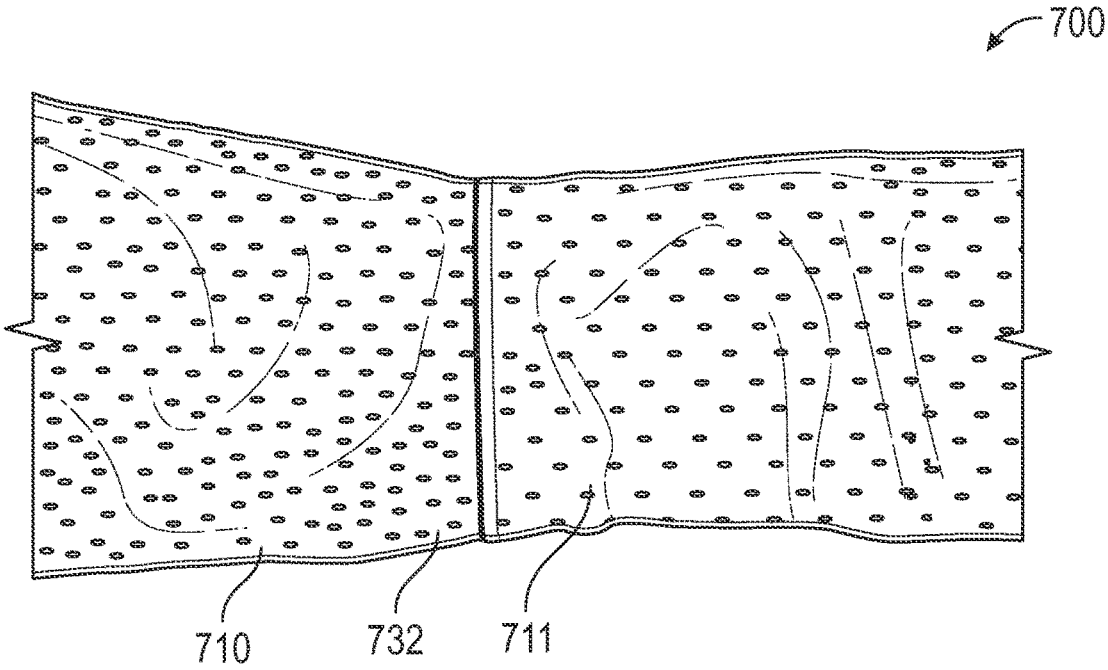
FIG. 30 is an enlarged view of another portion of the second side of the gym wrap device of FIG. 26.
Figure 31:
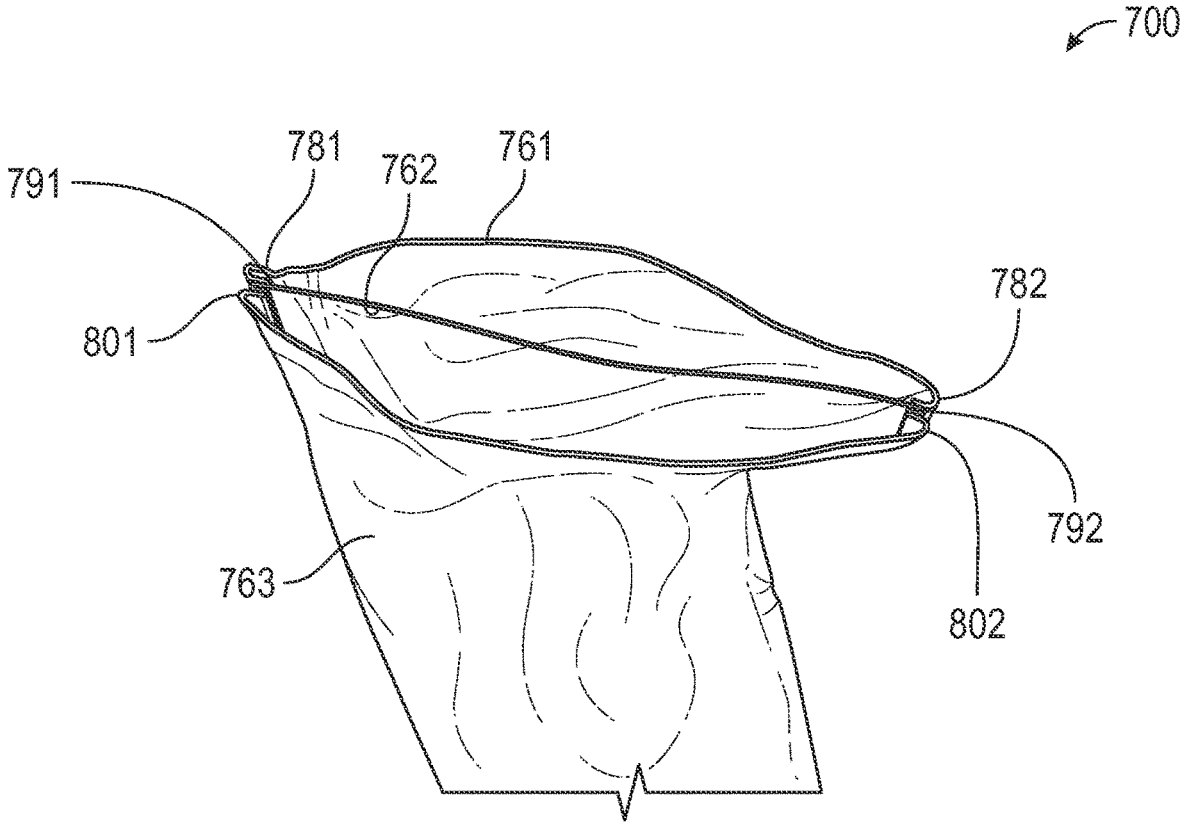
FIG. 31 is a view of fabric layers of a central wrap portion of the gym wrap device of FIG. 25 taken along lines 31-31 in FIG. 25.

Referring to FIGS. 27, 28 and 31, the central wrap portion 710 includes a first edge portion 781, a second edge portion 782, a first end portion 751, a second end portion 752, a polyester mesh fabric layer 761, a moisture activated cooling mesh fabric layer 762, and a polyester mesh fabric layer 763.

Referring to FIGS. 25 and 31, the polyester mesh fabric layer 761 is coupled to and contacts the moisture activated cooling mesh fabric layer 762 and is configured to contact a head of a user. The polyester mesh fabric layer 761 has a first edge portion 781, a second edge portion 782, and a plurality of holes 770 extending therethrough. Each of the plurality of holes 770 has a first opening size. In an exemplary embodiment, the first opening size has a diameter in a range of 2.5 to 3.5 millimeters which allows a portion of the sweat from a user to quickly propagate through the polyester mesh fabric layer 761 to the moisture activated cooling mesh fabric layer 762. Further, in an exemplary embodiment, the polyester mesh fabric layer 761 is a 100% polyester mesh fabric layer.

The moisture activated cooling mesh fabric layer 762 is coupled to and between the polyester mesh fabric layer 761 and the polyester mesh fabric layer 763. The moisture activated cooling mesh fabric layer 762 includes a first edge portion 791 and a second edge portion 792. The first edge portion 791 is coupled to the first edge portion 781 of the polyester mesh fabric layer 761 utilizing a plurality of stitches extending therethrough. The second edge portion 792 is coupled to the second edge portion 782 the polyester mesh fabric layer 761 utilizing a plurality of stitches extending therethrough.

The moisture activated cooling mesh fabric layer 762 is constructed of substantially 55% nylon yarn and substantially 45% polyester yarn. In an exemplary embodiment, the moisture activated cooling mesh fabric layer 762 is manufactured by Dongguan Xinlang Textile Technology Co., Ltd. having a business address of 3rd Floor, No. 1, 2nd Road, Bomei Longdi Industrial Zone, Humen Town, Dongguan City, Guangdong Province, China and a website https://xinlangtextile.en.alibaba.com and has a product SKU of XLAB0043NA which is constructed of substantially 55% nylon cold yarn and substantially 45% polyester cold yarn. Nylon cold yarn wicks away moisture from a wearer and provides a cooling sensation to the wearer. Further, polyester cold yarn wicks away moisture from a wearer and provides a cooling sensation to the wearer.

The moisture activated cooling mesh fabric layer 762 was tested by Intertek Testing Services Shenzhen Ltd. having an address of Room 801/901, No. 8, East Bao Ying Road, Huangpu District, Guangzhou, China—and an internet address of intertek.com. The tests performed by Intertek Testing Services Shenzhen Ltd indicated that moisture activated cooling mesh fabric layer 762 has a surface water absorption of 8 milli-liters in a 1 meter by 1 meter area of the moisture activated cooling mesh fabric layer 762. Further, the moisture activated cooling mesh fabric layer 762 has a maximum heat transfer coefficient of 0.135 Watts/$cm^2$ such that heat energy is effectively conducted away from the head of the user—which is greater than other fabric layers. Also, the moisture activated cooling mesh fabric layer 762 has a wicking rate in a range of 3.3 millimeters/second to 4.0 millimeters/second such that moisture is wicked away from the head of the user.

In summary, the moisture activated cooling mesh fabric layer 762 has a surface water absorption that is greater than other fabrics which allows the gym wrap device 700 to desirably absorb more moisture from the head of a user than other gym wrap devices. Further, the fabric layer 762 has a maximum heat transfer coefficient that is greater than other fabrics which allows the gym wrap device 700 to conduct more heat energy away from the head of the user than other gym wrap devices to more effectively cool the head of the user. Further, the fabric layer 762 has a wicking rate that is greater than other fabrics which allows the gym wrap device 700 to move the moisture more effectively from the head of the user for evaporation therefrom. During use, the moisture activated cooling mesh fabric layer 762 has a capillary-like structure that absorbs sweat from the layer 761 and circulates moisture throughout the layer 7624, and regulates the evaporation rate and releases water vapor molecules into the air to produce a cooling effect of the user.

The polyester mesh fabric layer 763 is coupled to and contacts the moisture activated cooling mesh fabric layer 762. The polyester mesh fabric layer 763 has a first edge portion 801, a second edge portion 802, and a plurality of holes 810 extending therein. Each of the plurality of holes 810 has a first opening size. In an exemplary embodiment, the first opening size has a diameter in a range of 2.5 to 3.5 millimeters which provides a larger evaporation region on the exterior of the polyester mesh fabric layer 763 to evaporate the moisture. Further, in an exemplary embodiment, the polyester mesh fabric layer 763 is a 100% polyester mesh fabric layer.

Figure 32:
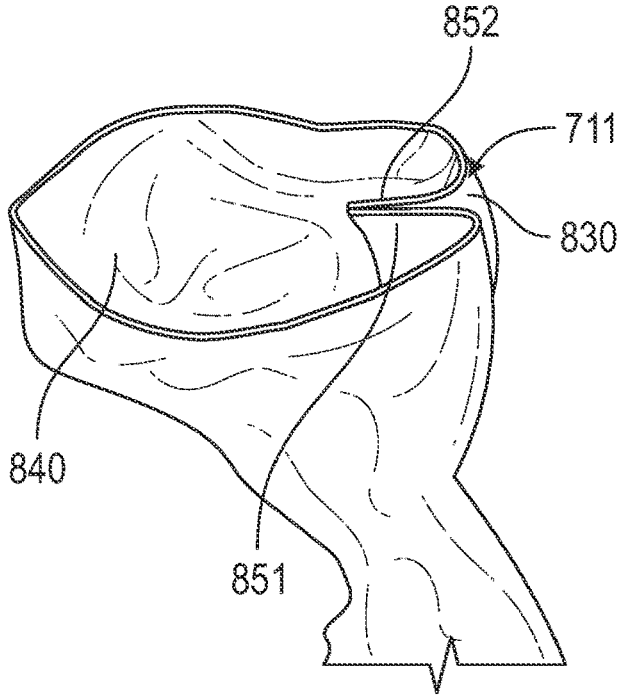
FIG. 32 is a view of a folded fabric layer of a first end wrap portion of the gym wrap device of FIG. 25 taken along lines 32-32 in FIG. 25.
Figure 35:
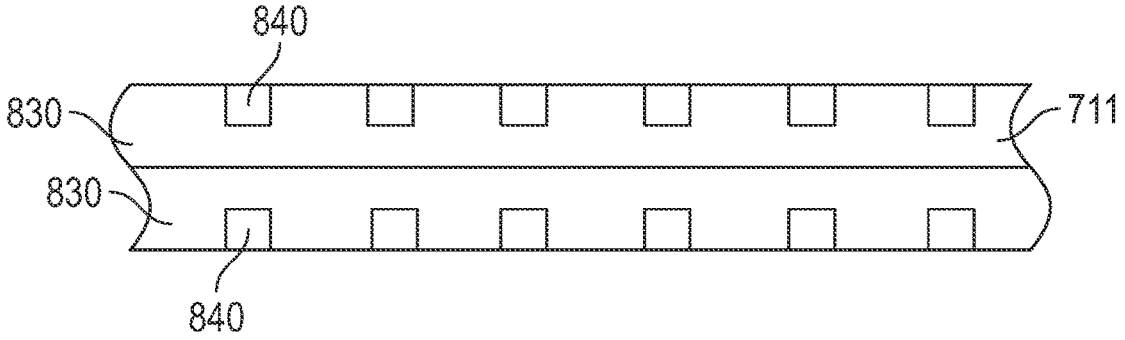
FIG. 35 is an enlarged simplified cross-sectional view of a first end wrap portion of the gym wrap device of FIG. 26 taken along lines 35-35 in FIG. 26.
Figure 36:
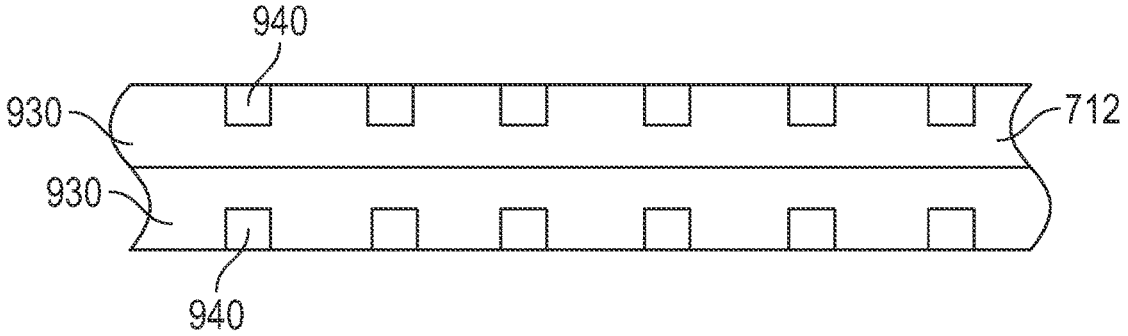
FIG. 36 is an enlarged simplified cross-sectional view of a second end wrap portion of the gym wrap device of FIG. 26 taken along lines 36-36 in FIG. 26.

Referring to FIGS. 27, 32, and 35, the first end wrap portion 711 is coupled to the first end portion 751 of the central wrap portion 710. The first end wrap portion 711 is constructed of a polyester mesh fabric layer 830 that is folded over onto itself. The polyester mesh fabric layer 830 has a first edge portion 851, a second edge portion 852, and a first end portion 861. The first and second edge portions 851, 852 are coupled together utilizing stitches extending therethrough. The first end portion 861 is coupled to the first end portion 751 of the central wrap portion 710 utilizing a plurality of stitches extending therethrough. Further, the polyester mesh fabric layer 830 has a plurality of holes 840 extending therein. Each of the plurality of holes has the second opening size. In an exemplary embodiment, the second opening size has a diameter in a range of 1.2 to 2.0 millimeters which allows a portion of the sweat from a user to quickly propagate through the polyester mesh fabric layer 830.

Figure 33:
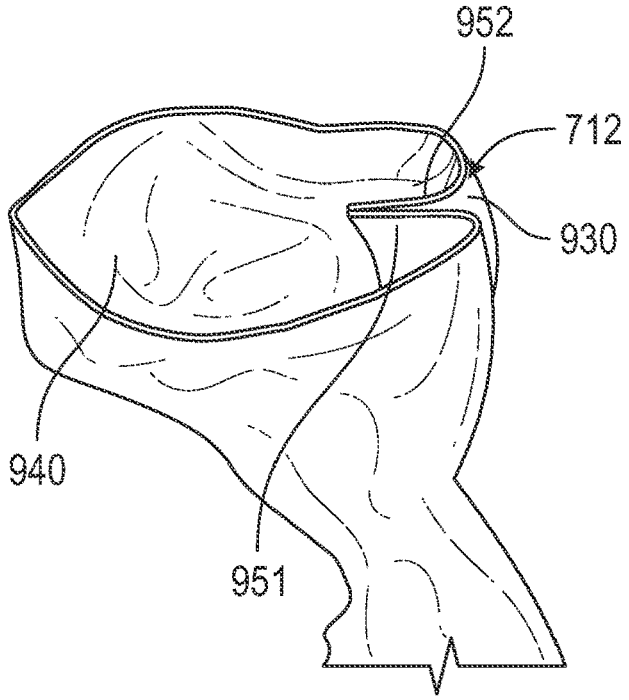
FIG. 33 is a view of a folded fabric layer of a second end wrap portion of the gym wrap device of FIG. 25 taken along lines 33-33 in FIG. 25.
Figure 34:
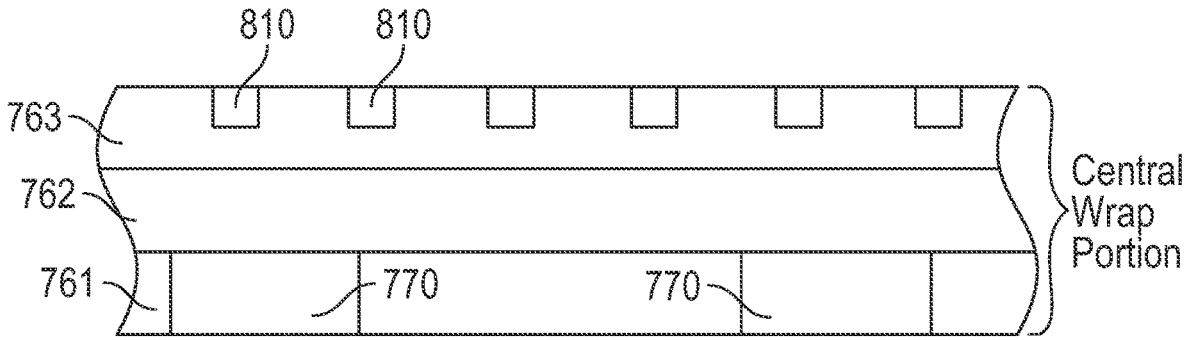
FIG. 34 is an enlarged simplified cross-sectional view of central wrap portion of the gym wrap device of FIG. 26 taken along lines 34-34 in FIG. 26.

Referring to FIGS. 28, 33, and 34, the second end wrap portion 712 is coupled to the second end portion 752 of the central wrap portion 710. The second end wrap portion 712 is constructed of a polyester mesh fabric layer 930 that is folded over onto itself. The polyester mesh fabric layer 930 has a first edge portion 951, a second edge portion 952, and a first end portion 961. The first and second edge portions 951, 952 are coupled together utilizing stitches extending therethrough. The first end portion 961 is coupled to the second end portion 751 of the central wrap portion 710 utilizing a plurality of stitches extending therethrough. Further, the polyester mesh fabric layer 930 has a plurality of holes 840 extending therein. Each of the plurality of holes has the second opening size. In an exemplary embodiment, the second opening size has a diameter in a range of 1.2 to 2.0 millimeters which allows a portion of the sweat from a user to quickly propagate through the polyester mesh fabric layer 930.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description. Also, the tightly spaced dashed lines illustrated in the figures represents exemplary stitches.

The invention claimed is:

1. A gym wrap device, comprising:

a central wrap portion;

first and second end wrap portions being coupled to first and second ends, respectively, of the central wrap portion;

the central wrap portion having a first polyester mesh fabric layer, a moisture activated cooling mesh fabric layer, and a second polyester mesh fabric layer;

the first polyester mesh fabric layer being configured to contact a head of a user, the first polyester mesh fabric layer having a plurality of holes extending through the first polyester mesh fabric layer, each of the plurality of holes of the first polyester mesh fabric layer having a first opening size;

the moisture activated cooling mesh fabric layer being coupled to the first polyester mesh fabric layer, the moisture activated cooling mesh fabric layer being constructed of substantially 55% nylon yarn and substantially 45% polyester yarn; and the second polyester mesh fabric layer being coupled to the moisture activated cooling mesh fabric layer such that the moisture activated cooling mesh fabric layer is disposed between and contacting the first and second polyester mesh fabric layers, the second polyester mesh fabric layer having a plurality of holes extending partially into but not through the second polyester mesh fabric layer, each of the plurality of holes of the second polyester mesh fabric layer having a second opening size, wherein the second opening size is smaller than the first opening size.

2. The gym wrap device of claim 1, wherein:

the moisture activated cooling mesh fabric layer being constructed of substantially 55% nylon cold yarn and substantially 45% polyester cold yarn, wherein nylon cold yarn and polyester cold yarn are each configured to wick moisture away from a wearer of the gym wrap device so as to provide a cooling sensation.

3. The gym wrap device of claim 1, wherein:

the first end wrap portion being constructed of a third polyester mesh fabric layer folded over thereon having a plurality of holes extending therein; each of the plurality of holes of the third polyester mesh fabric layer having the second opening size;

the second end wrap portion being constructed of a fourth polyester mesh fabric layer folded over thereon having a plurality of holes extending therein; each of the plurality of holes of the fourth polyester mesh fabric layer having the second opening size.

4. The gym wrap device of claim 1, wherein:

the moisture activated cooling mesh fabric layer has a surface water absorption of 8 milli-liters in a 1 meter by 1 meter area of the moisture activated cooling mesh fabric layer.

5. The gym wrap device of claim 1, wherein:

each of the first and second polyester mesh fabric layers being a 100% polyester mesh fabric layer.

6. The gym wrap device of claim 1, wherein:

the moisture activated cooling mesh fabric layer having a capillary-like structure that is configured to absorb sweat from polyester mesh fabric layer, to circulate moisture throughout the moisture activated cooling mesh fabric layer, and to release water vapor molecules into the air to produce a cooling effect for a wearer of the gym wrap device.

7. The gym wrap device of claim 1, wherein:

the second polyester mesh fabric layer includes an interior side that contacts the moisture activate cooling mesh fabric layer and an exterior side that is opposite from the interior side, and the plurality of holes in the second polyester mesh fabric layer extend partially into the second polyester mesh fabric layer from the exterior side but do not extend completely through the second polyester mesh fabric layer to the interior side.

* * * * *